US010669745B2

(12) United States Patent
Liddell et al.

(10) Patent No.: US 10,669,745 B2
(45) Date of Patent: Jun. 2, 2020

(54) SMART LOCK, SYSTEM AND METHOD

(71) Applicant: GLUE AB, Stockholm (SE)

(72) Inventors: Sarah Liddell, Malmesbury (GB); Tai Jung Lee, London (GB); Andrew Guscott, Birdham (GB); Nicolas Thiers, Sandillon (FR); Dany Lebrun, Sandillon (FR)

(73) Assignee: Glue AB, Stockholm (SE)

( * ) Notice: Subject to any disclaimer, the term of this patent is extended or adjusted under 35 U.S.C. 154(b) by 0 days.

(21) Appl. No.: 15/759,458

(22) PCT Filed: Sep. 16, 2016

(86) PCT No.: PCT/EP2016/072074

§ 371 (c)(1),
(2) Date: Mar. 12, 2018

(87) PCT Pub. No.: WO2017/046399

PCT Pub. Date: Mar. 23, 2017

(65) Prior Publication Data

US 2018/0179785 A1 Jun. 28, 2018

(30) Foreign Application Priority Data

Sep. 16, 2015 (GB) ..... 1516435.3

(51) Int. Cl.
*E05B 47/00* (2006.01)

(52) U.S. Cl.
CPC .. *E05B 47/0012* (2013.01); *E05B 2047/0091* (2013.01); *E05B 2047/0095* (2013.01)

(58) Field of Classification Search
CPC ..... E05B 47/0012; E05B 2047/0095; E05B 2047/0091; E05B 43/00; E05B 43/005;
(Continued)

(56) References Cited

U.S. PATENT DOCUMENTS 3,940,738 A 2/1976 Teeters
4,901,545 A * 2/1990 Bacon ..... E05B 13/10 70/207

(Continued)

FOREIGN PATENT DOCUMENTS

EP 2 042 672 A1 4/2009
WO WO 2011/160628 A1 12/2011

(Continued)

OTHER PUBLICATIONS

International Search Report and Written Opinion of the International Searching Authority, International Application No. PCT/EP2016/072074, Nov. 16, 2016, 11 pages.

(Continued)

*Primary Examiner* — Lloyd A Gall
(74) *Attorney, Agent, or Firm* — Myers Bigel, P.A.

(57) ABSTRACT

A smart lock (1) for securing a closure (5), for example a swing door, comprising: an actuator configured to actuate a lock mechanism contained within the closure to secure and/or to release the lock mechanism; and a receiver configured to wirelessly receive a signal to control operation of the actuator. An associated system and methods are also described.

23 Claims, 19 Drawing Sheets

(58) Field of Classification Search
CPC ..... E05B 2047/002; E05B 2047/0026; E05B 2047/0028; E05B 47/026
USPC ..... 70/267–274, 277, 278.1–278.7, 279.1, 70/280–283, 283.1; 292/144, DIG. 37; 340/5.61–5.64, 5.51, 5.54, 5.55, 5.7, 5.28
See application file for complete search history.

(56) References Cited

U.S. PATENT DOCUMENTS

| | | | | |
|---|---|---|---|---|
| 5,609,051 | A * | 3/1997 | Donaldson | E05B 47/0673 340/5.54 |
| 9,546,504 | B2 | 1/2017 | Overgaard | |
| 2003/0209042 | A1 | 11/2003 | Yeh et al. | |
| 2006/0114099 | A1 * | 6/2006 | Deng | G07C 9/00563 340/5.53 |
| 2007/0200666 | A1 * | 8/2007 | Howard | E05B 65/0035 340/5.62 |
| 2009/0211319 | A1 | 8/2009 | McCormack | |
| 2010/0089109 | A1 * | 4/2010 | Bliding | E05B 17/0062 70/280 |
| 2012/0073338 | A1 * | 3/2012 | Mohla | E05B 47/0012 70/124 |
| 2013/0089109 | A1 * | 4/2013 | Mital | H04L 69/22 370/431 |
| 2014/0326027 | A1 | 11/2014 | Avganim | |
| 2014/0360232 | A1 | 12/2014 | Al-Kahwati et al. | |
| 2015/0102927 | A1 | 4/2015 | Johnson et al. | |

FOREIGN PATENT DOCUMENTS

| | | | |
|---|---|---|---|
| WO | 2016/023558 | A1 | 2/2016 |
| WO | 2016/045679 | A1 | 3/2016 |

OTHER PUBLICATIONS

Domadoo, "[CES2014]—Poly-control—Presentation de la nouvelle serrure DanaLock", https://www.youtube.com/watch?v=EOzz90--J1g, (1 page) (uploaded Jan. 13, 2014) (site visited Jan. 16, 2020).
polycontroll, "DanaLock Circle Euro", https://www.youtube.com/watch?v=ZxFd3gyVbTY, (1 page) (uploaded Dec. 8, 2013) (site visited Jan. 16, 2020).
Communication pursuant to Aricle 94(3) EPC, EP Application No. 16769969.3, dated Feb. 7, 2020, 4 pp.
Noki Home Solution GmbH: "Noki: The smart doorlock for Europe", May 12, 2015 (May 12, 2015); Retreived from the Internet: URL:https:www.kickstarter.com/projects/122749759/noki-the-smart-doorlock-for-europe/description [dated Oct. 18, 2019], 7 pp.

* cited by examiner

SMART LOCK, SYSTEM AND METHOD

RELATED APPLICATIONS

This application is a 35 U.S.C. § 371 national stage application of PCT Application No. PCT/EP2016/072074, filed on Sep. 16, 2016, which claims priority from Great Britain Patent Application No. 1516435.3, filed on Sep. 16, 2015, the contents of which are incorporated herein by reference in their entireties. The above-referenced PCT International Application was published in the English language as International Publication No. WO 2017/046399 A1 on Mar. 23, 2017.

The present disclosure is directed to a smart lock, system and associated methods that provide a means of unlocking a door or other closure without a mechanical key. In addition, the smart lock of the present disclosure allows a user to manage access through the door or closure for third parties, e.g. delivery companies, cleaning companies, childcare providers and other visitors.

BACKGROUND TO THE DISCLOSURE

Door furniture in the form of mechanical locks are well known as a means for securing closures that can be moved between closed and open positions. A common example of a closure is a swing door that is mounted to a frame by one or more hinges. Mechanical locks for swing doors are known and typically function by providing a shoot bolt or similar member that can be moved by means of a physical key between a locked position—in which the shoot bolt projects into a rebate or recess in the frame to prevent opening of the door—and an unlocked position—in which the shoot bolt is drawn clear of the rebate or recess to permit opening of the door. Examples of such mechanical locks include mortice locks, rim latches and multi-point locks typically found on PVC doors.

A disadvantage of such mechanical locks is that a physical key is required for their operation. Said key may be lost by the user or may not easily be to hand when the lock needs to be operated—e.g. when carrying hand baggage. Another disadvantage is that if a user wishes to permit a third party to have access through the door or other closure they must make arrangements to either delivery the physical key to the third party prior to arrival, which is inconvenient, or leave the key hidden near the door, which is insecure.

SUMMARY OF THE DISCLOSURE

In a first aspect, the present disclosure provides a smart lock for securing a closure, for example a swing door, comprising:

an actuator configured to actuate a lock mechanism contained within the closure to secure and/or to release the lock mechanism; and a receiver configured to wirelessly receive a signal to control operation of the actuator.

The receiver may be configured to be paired with a mobile device, for example a smartphone, and to detect presence of the mobile device within a field of range of the receiver for controlling operation of the actuator such that presence of the mobile device within the field of range of the receiver results in release of the lock mechanism.

The receiver may be configured to receive a signal from a third party mobile device and to confirm with an external server permission for actuation of the lock mechanism by the third party device.

Confirmation of permission may involve verification of a current time with a permission time.

The receiver may comprise a Bluetooth receiver, which may be a near field Bluetooth receiver.

The receiver may comprise a Wi-Fi receiver.

The smart lock may further comprise a thumb turn wheel to allow manual operation from the interior.

The thumb turn wheel may comprise a textured exterior.

The thumb turn wheel may comprise a button configured to actuate the lock mechanism contained within the closure to secure the lock mechanism after a predetermined delay period.

The button may be configured to actuate the lock mechanism contained within the closure to secure the lock mechanism after a predetermined delay period when pressed twice in succession.

The predetermined delay period may be set by operation of an external app.

The smart lock may comprise a housing having a front cover through which a thumb turn wheel projects wherein the front cover is pivotally connected to the housing about an axis of rotation of the thumb turn wheel.

The housing and the front cover may each comprise complementary magnets that rotatably retain the front cover in a closed position.

The housing may comprise a battery compartment that is accessible when the front cover is in an open position.

The housing may comprise locations for receiving fixatives, for example screws or bolts, for fixing the smart lock to the closure, wherein the locations may be accessible for installing or removing the fixatives simply by rotating the cover to an open position.

The smart lock may be retro-fittable to a closure and a shoot bolt of a pre-existing lock of the closure.

The smart lock may be retro-fittable to a closure in more than one orientation.

The smart lock may be pairable to a hub by wireless communication, for example Wi-Fi.

Operation of the smart lock may be configurable remotely via the hub.

The actuator may comprise a prime mover and a drive train for transmitting motion of the prime mover to actuate the lock mechanism.

The prime mover may be an electric motor.

The drive train may comprise a clutch assembly.

The prime mover and the clutch assembly may be operatively engaged with each other.

The clutch assembly may comprise a clutch body, a clutch and a clutch gear.

The clutch body, clutch and clutch gear may be mounted concentrically.

The clutch gear may be configured to be driven by the prime mover, preferably by engagement of gear teeth of the clutch gear with gear teeth coupled to the prime mover.

The prime mover may drive a pinion gear and the clutch gear may be a bevelled gear, wherein the axis of rotation of the pinion gear and bevelled gear may be perpendicular to one another.

The clutch may be selectively engagable with a stop member of the clutch body to transmit torque from the clutch to the clutch body.

The clutch may comprise a clutch ring and a clutch tab, the clutch tab being selectively engagable with a stop member of the clutch body to transmit torque from the clutch to the clutch body.

The clutch gear may comprise a stop member that is selectively engageable with the clutch to transmit torque from the clutch gear to the clutch.

The prime mover and the clutch assembly may be mounted to a motor carriage.

The prime mover and the clutch assembly may be mounted in a plurality of configurations on the motor carriage.

The plurality of configurations may comprise at least a first configuration and a second configuration.

The drive train may comprise a thumb turn wheel to allow manual operation of the lock mechanism.

The drive train may be driven in a first mode by the prime mover and in a second mode by manual rotation of the thumb turn wheel without operation of the prime mover.

The drive train may be driven in a third mode by operation of the lock mechanism contained within the closure.

The drive train may comprise a geared transmission assembly between a thumb turn wheel and the clutch assembly.

The geared transmission assembly may comprise an input shaft for receiving torque from the thumb turn wheel.

The geared transmission assembly may comprise at least a first output shaft and a second output shaft for supplying torque to the clutch assembly.

The geared transmission assembly may comprise a gear train coupling the first output shaft and the second output shaft.

Either the first output shaft or the second output shaft may be coupled to the clutch assembly dependent on whether the prime mover and the clutch assembly are mounted to a motor carriage in a first configuration or a second configuration.

The drive train may comprise an insert for transmitting torque between the clutch assembly and the lock mechanism.

The insert may be configured to be coupled between the clutch mechanism and a lock tailpiece of the lock mechanism.

The insert may be selected from a plurality of types of insert, each type of insert being configured to fit a different design of lock tailpiece.

The lock tailpiece may be configured to replace a whole or a part of the lock mechanism of the closure.

The lock tailpiece may be pre-existing in the lock and shoot bolt of the door closure, or selected from a plurality of types of lock tailpiece, each type of lock tailpiece being configured to be used with a different design of lock mechanism.

The smart lock may further comprise a mounting plate.

The mounting plate may be selected from a plurality of types of mounting plate, each type of mounting plate being configured to be used with a different design of lock mechanism.

In another aspect, the present disclosure provides a locking system comprising a smart lock as described above, a hub and an app.

The system may further comprise a plurality of inserts, wherein a one of the plurality of inserts may be selected for installing the smart lock on a closure containing a locking mechanism.

Each type of insert may be configured to fit a different design of lock tailpiece.

The system may further comprise a plurality of mounting plates, wherein a one of the plurality of mounting plates may be selected for installing the smart lock on a closure containing a locking mechanism.

Each type of mounting plate may be configured to fit a different design of lock mechanism.

In another aspect, the present disclosure provides a method of operating a smart lock to secure and/or to release a closure, for example a swing door, comprising:

operating an actuator to actuate a lock mechanism contained within the closure to secure and/or to release the lock mechanism; and utilising a receiver to wirelessly receive a signal to control operation of the actuator.

The receiver may be paired with a mobile device, for example a smartphone, and may detect the presence of the mobile device within a field of range of the receiver to control operation of the actuator such that presence of the mobile device within the field of range of the receiver results in release of the lock mechanism.

The receiver may receive a signal from a third party mobile device and confirm with an external server permission for actuation of the lock mechanism by the third party device.

Confirmation of permission may involve verification of a current time with a permission time.

The method may comprise use of a Bluetooth receiver, for example a near field Bluetooth receiver.

The method may comprise use of a Wi-Fi receiver.

The method may comprise turning a thumb turn wheel to allow manual operation from an interior.

The method may comprise using a button of the thumb turn wheel to actuate the lock mechanism contained within the closure to secure the lock mechanism after a predetermined delay period.

The method may comprise pressing the button twice to actuate the lock mechanism contained within the closure to secure the lock mechanism after a predetermined delay period.

The method may comprise setting the predetermined delay period by operation of an external app.

The smart lock may be pairable to a hub by wireless communication, for example Wi-Fi.

Operation of the smart lock may be configurable remotely via the hub.

The smart lock may be activated in a variety of modes, including at least manual activation by rotation of a thumb turn wheel and driven actuation by operation of a prime mover of the smart lock.

The prime mover may be a motor that actuates a drive train of the smart lock.

The method may further comprise utilising secure encrypted server single use digital keys to operate the smart lock.

The secure encrypted server single use digital keys may allow one lock control operation (lock or unlock) each in a situation where the app is offline.

The method may further comprise calibrating during installation the smart lock to establish parameters of the lock mechanism of the closure in a firmware of the smart lock.

The method may comprise calibrating the smart lock by rotating a thumb turn wheel in to a series of orientations and storing these in an internal memory of the smart lock.

Parameters stored in the internal memory may comprise one or more of the start and stop position of rotation of the thumb turn wheel to carry out a command, the angular distance (for example in degrees) and duration (for example in seconds) of rotation, any positions that pauses in rotation are required and any "neutral position" that the lock should return to after the command has been carried out.

The smart lock may also utilise "over current detection" wherein the smart lock firmware detects when the motor is trying to drive against a hard mechanical end stop for greater than a specific period of time, for example 300-500 milliseconds, which then indicates that the shoot bolt of the lock mechanism has reached the end of its travel e.g. is fully open or fully closed. This may also be used to determine the orientation of the rotation. If the individual indicators of position do not tally up the smart lock determines that a malfunction has occurred. e.g. that the mechanical stop is detected in the wrong orientation which may indicate that the shoot bolt is not fully closed.

The smart lock, system and method of the present disclosure may have a number of advantages:

An output shaft of the motor may be fitted with a pinion gear that interacts and drives a clutch gear that may be in the form of bevelled gear. This bevelled gear may be mounted in such a way that the axis is at 90 degrees to the axis of the motor output shaft. This allows the motor to be positioned in the smart lock body in a way that reduces the overall size of the body and is therefore compatible with a larger range of closure configurations.

The bevelled gear may drive a clutch assembly which enables free rotation of the lock mechanism key and the thumb turn wheel without interaction with the motor.

The components of the clutch assembly may be mounted concentrically which allows for a smaller overall body size and is therefore compatible with a larger range of closure configurations.

The motor and clutch assembly may be mounted on the motor carriage which can be pre-assembled prior to assembly into the main body. This configuration allows for the motor and clutch assembly to be mounted in a variety of positions and orientations. This variety of positions enables the smart lock to be compatible with a wide range of closure lock configurations whilst still maintaining the same visual exterior components of the smart lock.

The thumb turn wheel may rotate around a fixed point and may be connected to the clutch assembly by means of the geared transmission assembly. This may enable the thumb turn wheel to maintain continuous power transmission to the existing closure lock mechanism, regardless of which position the motor and clutch assembly is mounted within the smart lock body. This enables the smart lock to be compatible with a wide range of closure lock mechanisms whilst still maintaining the same visual exterior components of the smart lock.

The geared transmission assembly may comprise multiple gears of a 1:1 ratio and idler gears to transmit the equivalent torque, force and rotational speed, regardless of the positional relationship between the motor and thumb turn wheel.

The cover over the batteries may rotate around a single centre of rotation regardless of the position of any of the internal components.

The battery cover may enable the user to change the batteries without the use of any tools.

The smart lock may contain multiple LEDs mounted in such a way that they communicate to the user that a command has be successfully or unsuccessfully carried out.

During installation calibration the user may rotate the thumb turn in to a series of orientations and these positions are stored by the smart lock's internal memory. This may then indicate to the smart lock what closure lock mechanism the smart lock is interacting with and the smart lock internal control system (firmware) may then control the lock appropriately. This may enable the smart lock to be compatible with a wider range of door lock mechanisms. For example the tailpiece on a standard deadbolt will rotate through 90 degrees between its open and closed positions. When the key is used from the outside to open and close the lock mechanism, the tailpiece is also rotated and therefore the insert and clutch body in the smart lock are rotated. During calibration the firmware may detect that the lock is rotated 90 degrees and is therefore of the deadbolt configuration. When subsequently controlling the lock it may control it through 90 degrees of rotation only (after which the motor may reverse direction to the neutral position so that the clutch is not engaged). When operating a Euro cylinder lock pr certain Scandinavian locks the lock may turn through 180 degrees. When operating certain other Scandinavian locks the lock may turn through 360 degrees. Each time the smart lock is calibrated it is then configured to operate the lock it is attached to to the optimum level. If it was not calibrated and configured this way the smart lock could try to turn a deadbolt requiring 90 degrees of motion though 360 degrees therefore unnecessarily wasting battery life.

BRIEF DESCRIPTION OF THE DRAWINGS

By way of example only, embodiments of the present disclosure will now be described with reference to, and as shown in, the following drawings, in which.

DETAILED DESCRIPTION

FIGS. 1 to 15 illustrate a smart lock 1 according to the present disclosure. In the following, by way of example only, the smart lock 1 will be described and illustrated for use in securing a domestic, swing door 5. However, the smart lock 1 may be used to secure other doors and other types of closure if desired.

The smart lock 1 is part of an ecosystem comprising the smart lock 1, a hub 2 (shown in FIG. 4) and an app (which may be installed and run on a suitable device, for example a smart phone). The ecosystem provides a means of unlocking a home without a physical key. The ecosystem also provides a 'digital home concierge service' in that through the smart lock 1 which is connected via the hub 2 to the app one can utilise the ecosystem to help manage deliveries, cleaners, childcare, visitors, etc.

The smart lock 1 is designed to retrofit a range of locks and doors globally. The smart lock 1 is retro fitted to the Interior face 6 of the door 5 as shown for example in FIGS. 16 to 18. The smart lock 1 is enabled to fit most Scandinavian, Euro cylinder and US deadlocks and can easily be installed by a customer. The smart lock 1 may be designed to interface with at least a part of the lock mechanism pre-existing within the door 5, for example, the shoot bolt.

Figure 1:
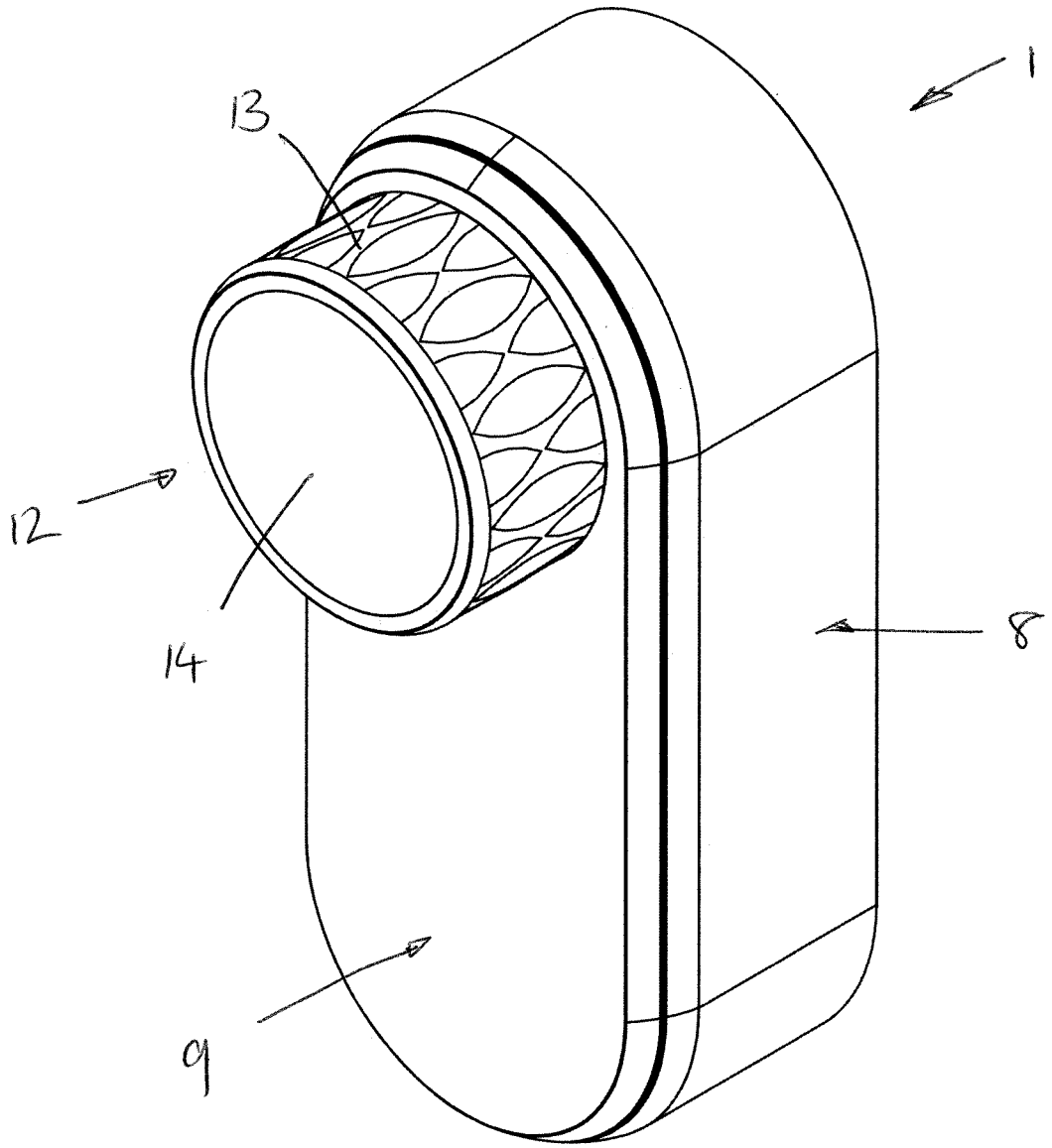
FIG. 1 is a perspective view of a smart lock according to the present disclosure.
Figure 2:
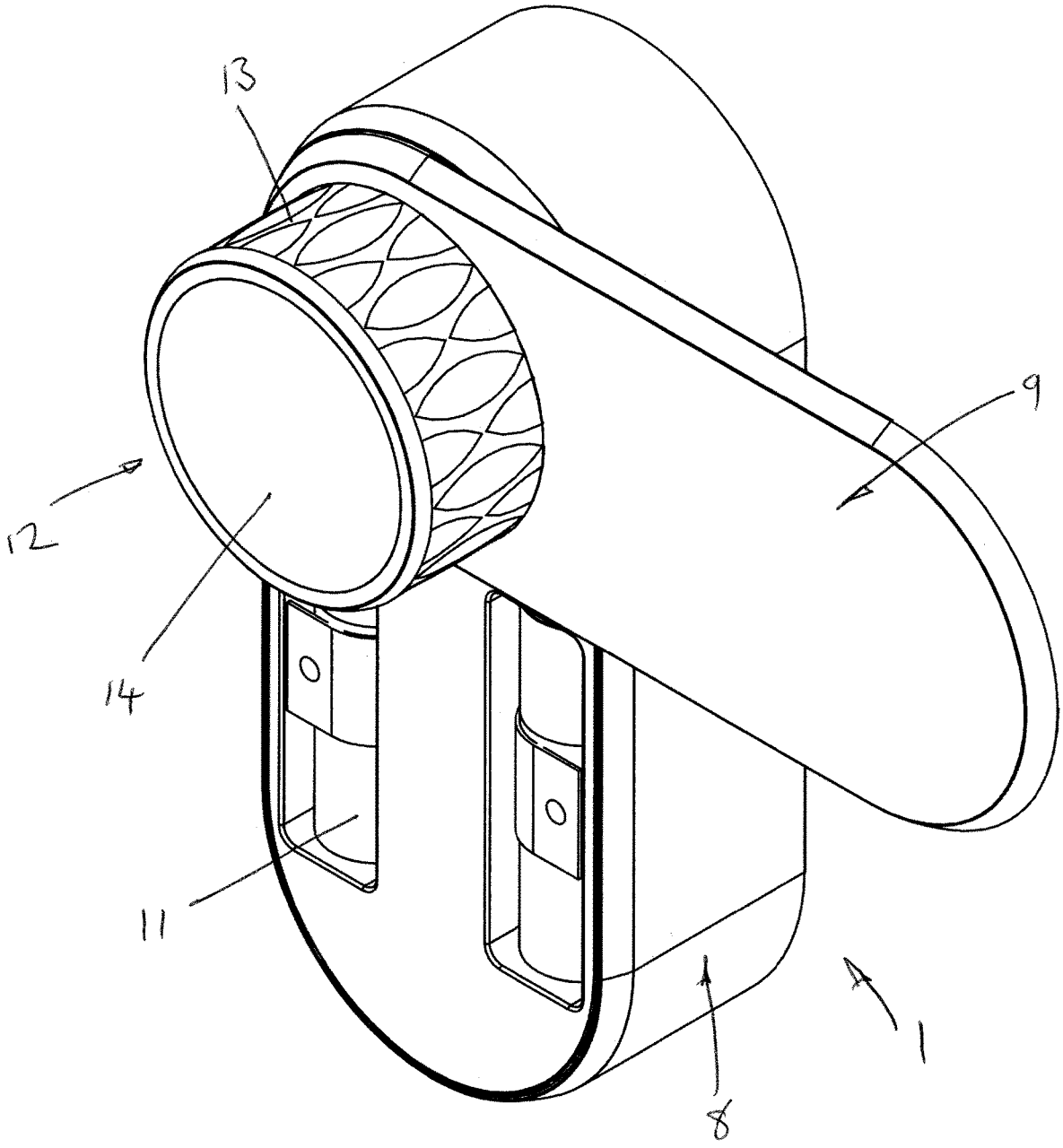
FIG. 2 is a perspective view of the smart lock of FIG. 1 with a front cover in an open position.
Figure 3:
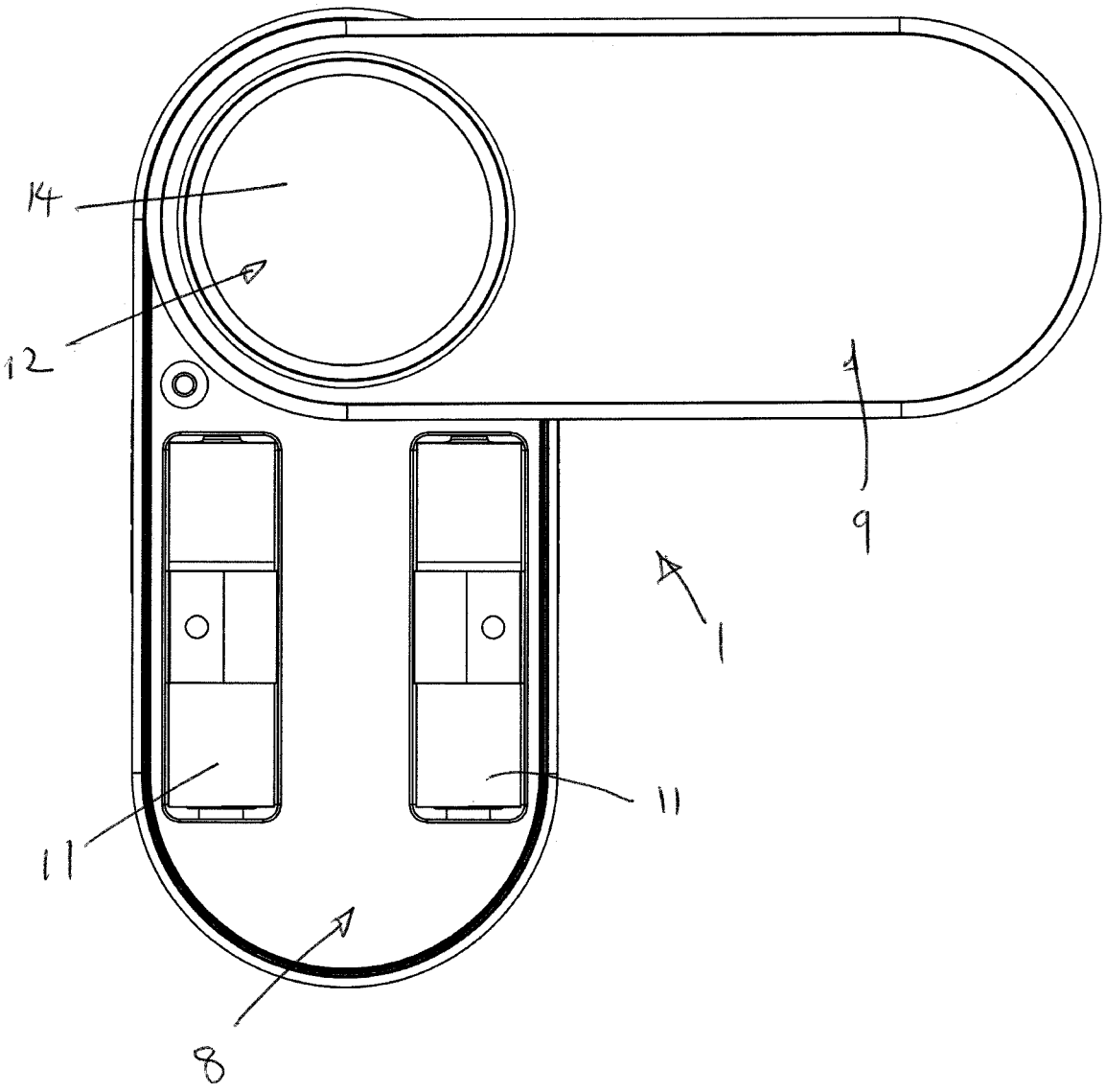
FIG. 3 is a front view of the smart lock of FIG. 2.
Figure 4:
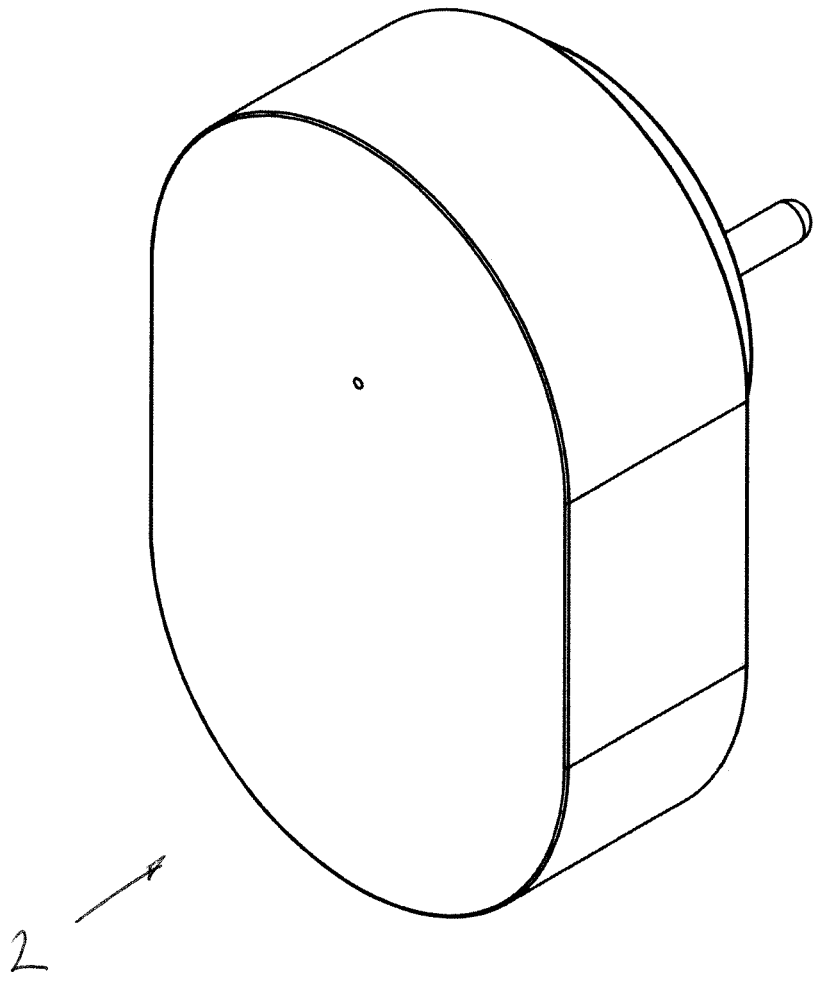
FIG. 4 is a perspective view of a hub that in use is associated with the smart lock of FIG. 1.

The smart lock 1 generally comprises a main body 8, a front cover 9, a motor and drive assembly, a thumb turn wheel 12 and a plurality of inserts 25 which interface with an existing lock tailpiece 105, 106 or a replacement lock tailpiece 105, 106 of the lock mechanism of the door 5. The smart lock 1 is efficiently powered by batteries 11 which are mounted within the interior of the smart lock 1 as shown in FIGS. 2 and 3.

The main body 8 may comprise an aluminium extrusion and may contain screw bosses that the products main components (e.g. the motor and drive assembly) are attached to, ensuring that all visual and functional tolerances are highly controlled. Advantageously, a continuous metal path through the smart lock 1 may be provided to ensure safety and security. For instance, all internal components that connect the thumb turn wheel 12 at the front of the smart lock 1 to the lock adaptor at the rear of the smart lock 1 are metal too to ensure a continuous durable link with the lock components within the door 5. The aluminium extrusion may be clear anodised to suit a wide range of door interiors and ease of colour matching during manufacture. The main body 8 may comprise an edge chamfer.

Figure 18:
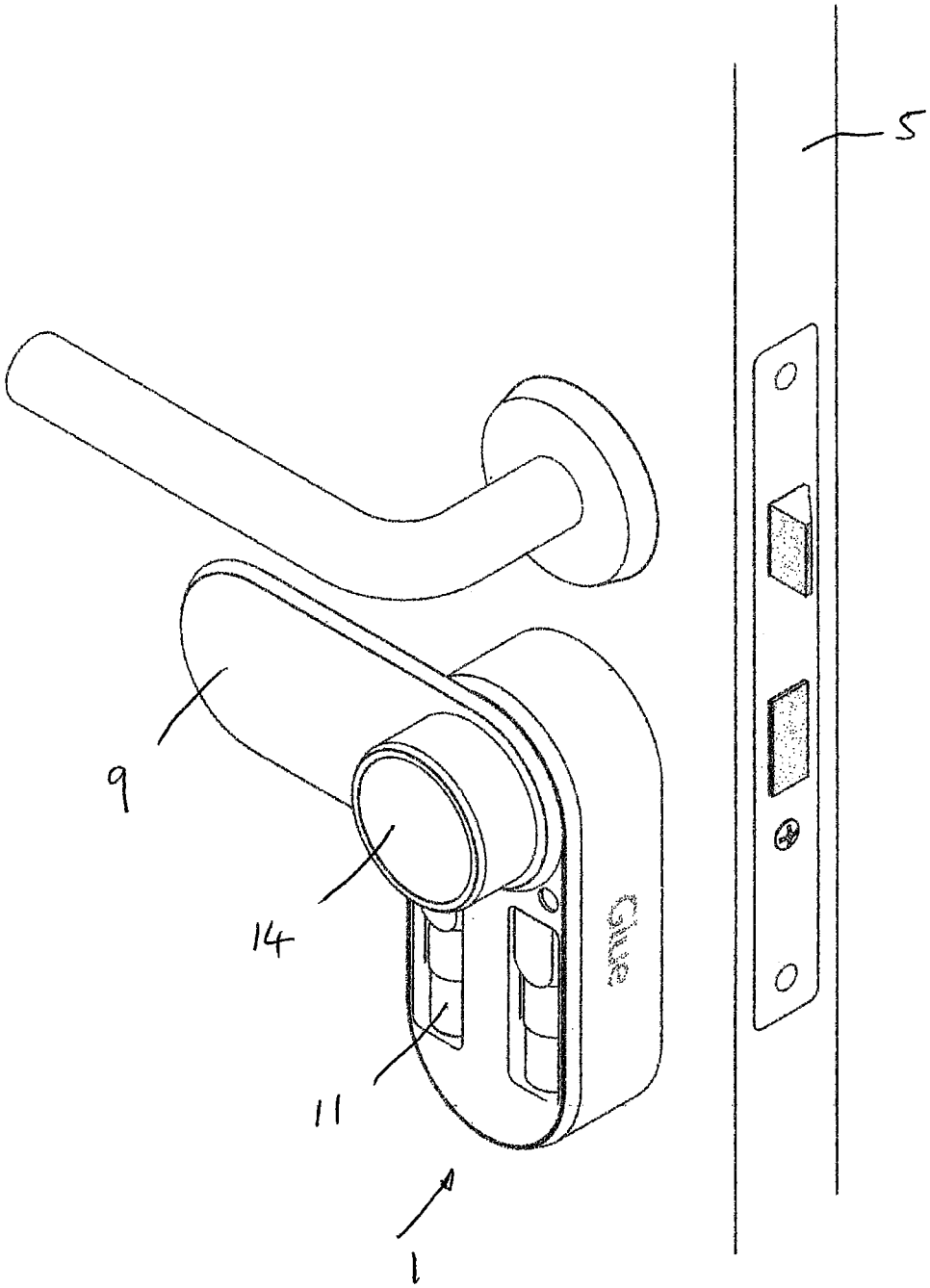
FIG. 18 is an illustration of the installation of FIG. 5 with a front cover of the smart lock in an open position.

The front cover 9 may be a two part construction and may be made from durable, impact resistant polycarbonate and back painted to enable a range of easily adaptable colour options, whilst also being BLE transparent. The front cover 9 assembly may rotate concentrically around the thumb turn wheel 12 as shown in FIGS. 2 and 18 to reveal the batteries 11 when they need replacing. The front cover 9 may also contain strategically positioned magnets that hold the front cover 9 either open for battery changing, or closed during use.

The thumb turn wheel 12 may comprise an outer textured surface 13 which may be produced by a CNC machining technique. The textured surface 13 enables users to grip and turn the thumb turn wheel 12 with ease, allowing the user to open and close the door manually from the interior if desired. The centre of the thumb turn wheel 12 may comprise a button 14 which may be used to activate the smart lock 1 as an alternative to using the app. For example, when the button 14 is double tapped, the smart lock 1 may be activated to conveniently secure the door 5 once the user has left—for example after a pre-set time delay. For this reason the thumb turn wheel centre may be clear back painted polycarbonate or glass which helps to convey the intuitive operation of a button. The duration of the predetermined or pre-set time delay may be configured by a user by operation of the app. In one example the predetermined time delay is 8 seconds.

The motor of the motor and drive assembly is housed within the main body 8 and acts as a prime mover of the smart lock 1 to output a torque to operate, via a drive train, the lock mechanism within the door 5 via the smart lock's insert 25. A clutch assembly 30 may be provided as will be described in more detail below. The clutch assembly 30 may form a part of the drive train.

Figure 5:
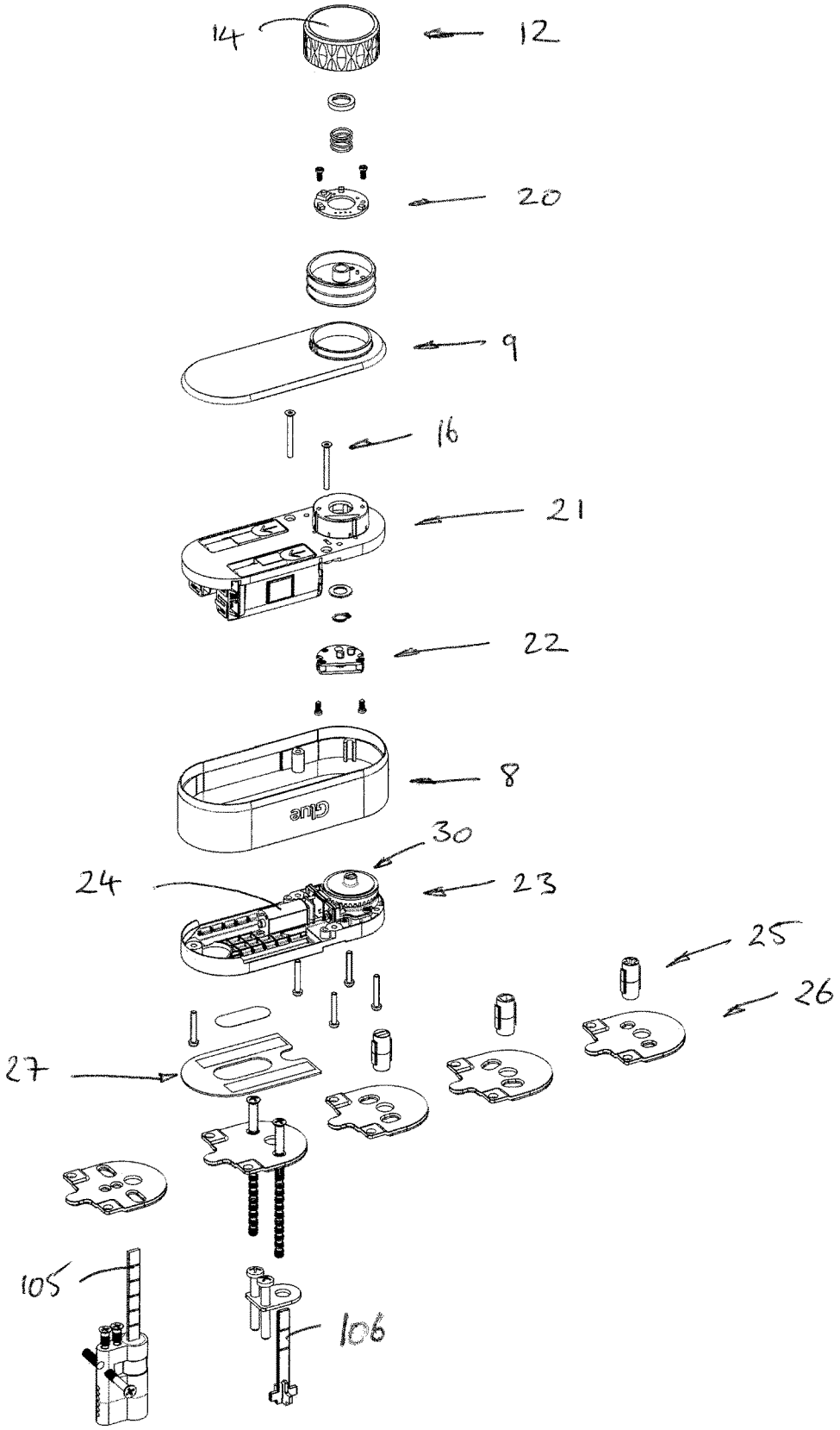
FIG. 5 is an exploded perspective view of the smart lock of FIG. 1.

The mechanical design of the smart lock 1 will now be described, by way of example only, in further detail with reference to FIGS. 5 to 15. As shown in FIG. 5, the main components of the smart lock 1 may include the thumb turn wheel 12, an LED assembly 20, the front cover 9, a battery housing 21, a geared transmission assembly 22, the main body 8, the motor 24, a motor carriage 23, the insert 25, a mounting plate 26, a vibration isolator 27 and a PCB 100. The smart lock 1 may be adapted to interface with the existing lock tailpiece 105, 106 of the lock mechanism of the door 5 or, where necessary, a replacement lock tailpiece 105, 106 may be provided with the smart lock 1 as part of a system which is fitted to the door 5 during installation. FIG. 5 shows a first type of lock tailpiece 105 and a second type of lock tailpiece 106. The first type of lock tailpiece 105 may form part of a Euro-cylinder type of lock mechanism. The second type of lock tailpiece 106 may form part of an Assa® design of lock mechanism found, for example, in Sweden. Other types of lock tailpiece may be driven by the smart lock 1 by provision of suitably shaped inserts 25. As noted above, the lock tailpieces 105, 106 may be provided as part of the smart lock 1 (in which case the lock tailpieces 105, 106 may be considered to form part of the drive train of the smart lock 1) or may be provided separately thereto as part of a system (in which case the lock tailpieces 105, 106 may be considered to be driven by the drive train of the smart lock 1).

Advantageously, the smart lock 1 can be configured to be compatible with a wide range of types of lock mechanism. This advantage is further enabled by the provision of a number of different types of mounting plate 26 and insert 25 as shown in FIG. 5. For example, FIG. 5 illustrates three inserts 25, the use of which will be described further below. One of the inserts 25 may be selected to be used as part of the smart lock 1 depending on the type of lock mechanism in use. Similarly, FIG. 5 illustrates five designs of mounting plate 26. One of these may be selected depending on the design of the lock mechanism in use. As shown in more detail in FIG. 7, the mounting plates 26 may be provided with an aperture to allow the insert 25 to project therethrough and also mounting apertures 49 to allow mounting screws 50 or similar fixatives to pass through to mount the mounting plate 26 to the closure such as a door 5. Additional mounting apertures 44 may also be provided which allow the main body 8 to be fixedly mounted to the mounting plate 26.

Figure 6:
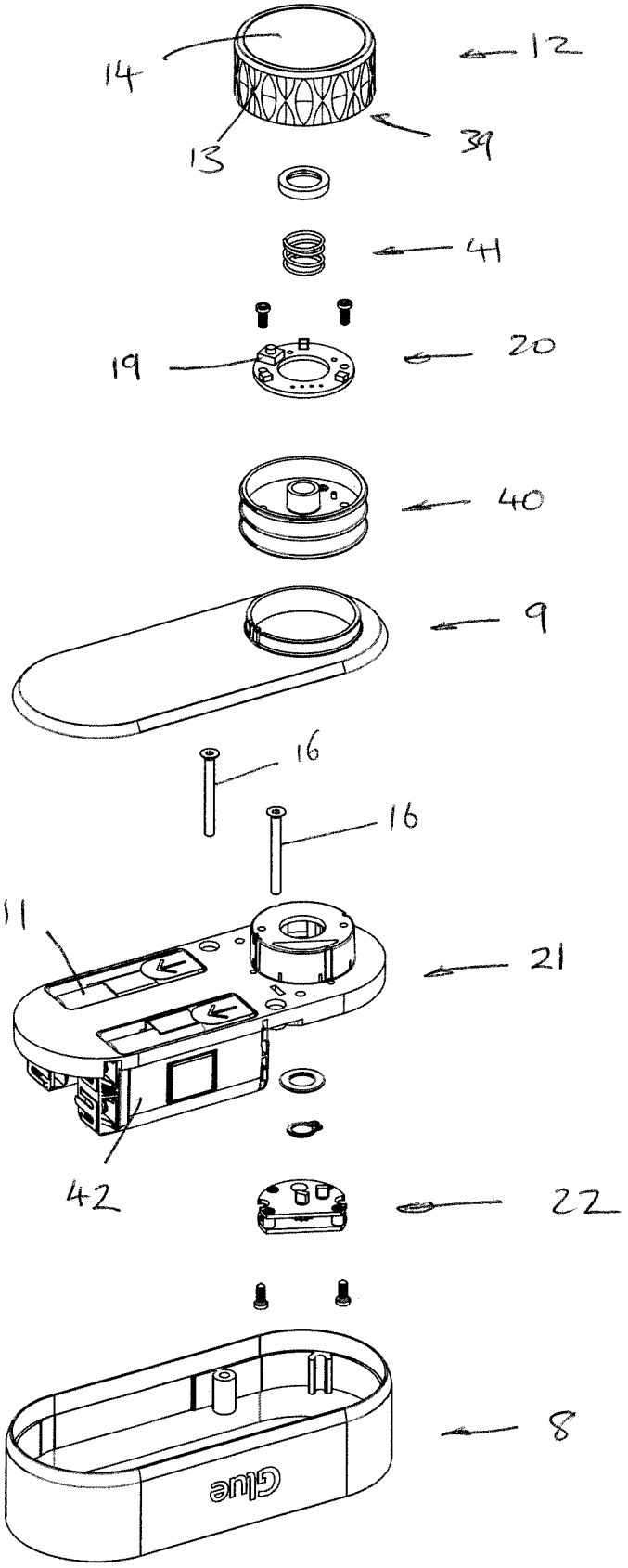
FIG. 6 is an enlarged view of a portion of FIG. 5.
Figure 7:
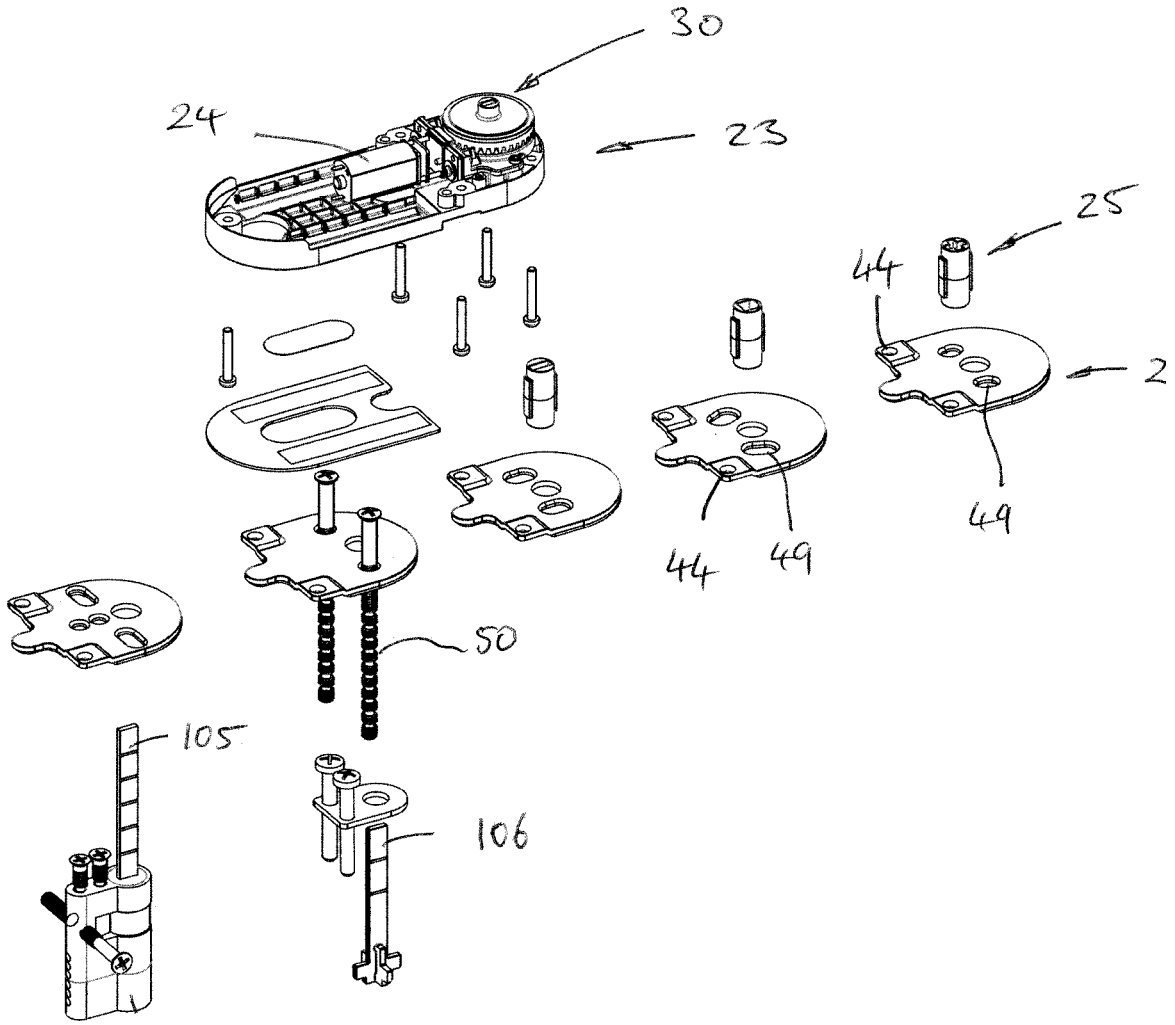
FIG. 7 is an enlarged view of another portion of FIG. 5.
Figure 13:
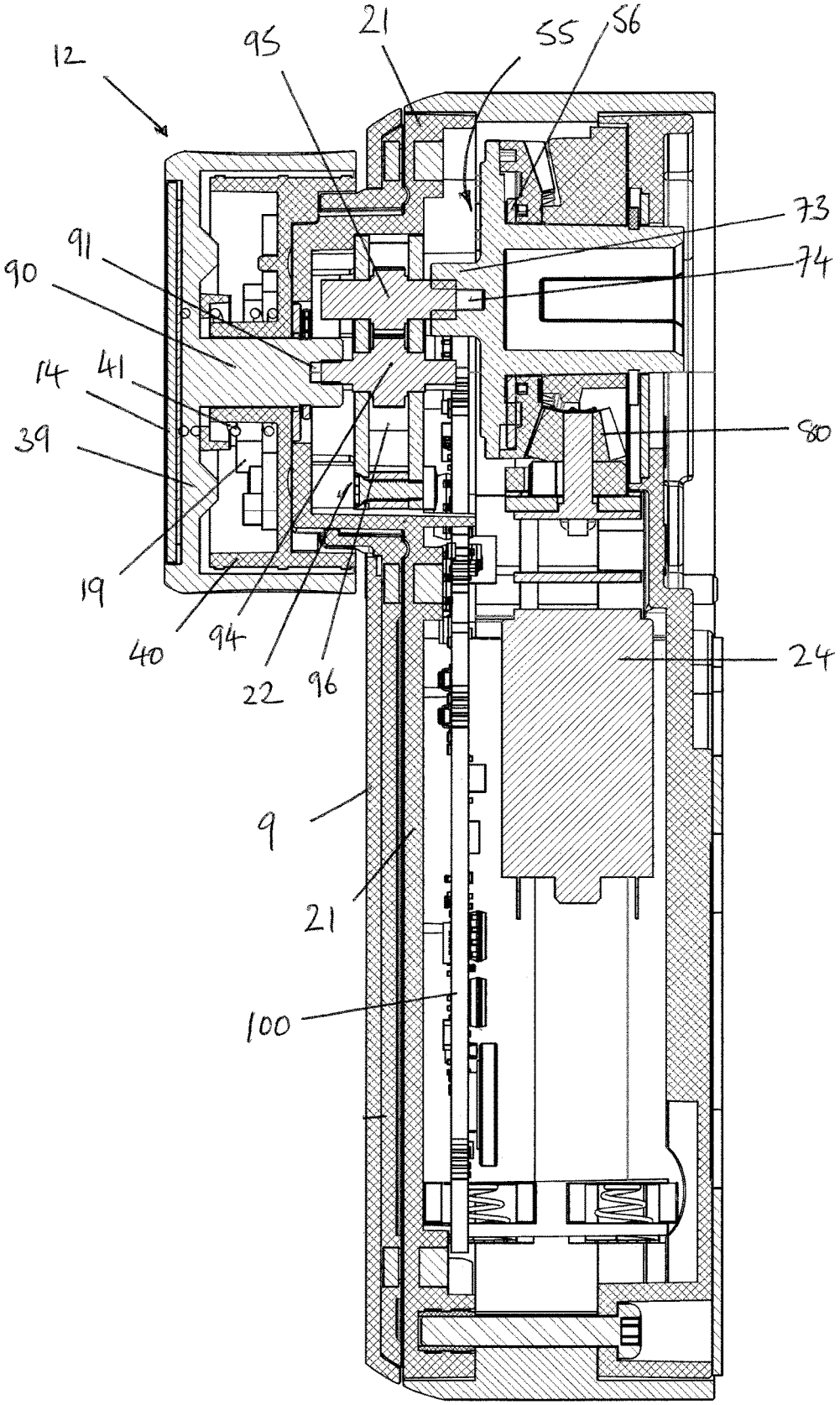
FIG. 13 is a sectional view of the smart lock of FIG. 1.

The components of the thumb turn wheel 12 are shown in more detail in FIG. 6 and FIG. 13 and may comprise a thumb turn wheel outer 39 which may bear the outer textured surface 13, a thumb turn wheel inner 40, the LED assembly 20 including a PCB-mounted switch 19, and a spring 41 together with other fixing components as required. As shown in FIG. 13, the thumb turn wheel outer 39 may comprise a spigot 90 which is received within an aperture of the thumb turn wheel inner 40 so that the thumb turn wheel outer 39 may rotate relative to the thumb turn wheel inner 40. An inner end of the spigot 90 may be provided with a keyway 91 which may be shaped as a slot the use of which will be described further below.

The smart lock 1 further comprises the PCB 100 which contains control circuitry, memory, processors, a receiver for wireless communication, etc. The PCB 100 may be mounted to an inner face of the battery housing 21 by suitable means such as adhesive or fixtures such as rivets, screws or bolts. Components of the PCB 100 may receive electric power from the batteries 11.

The LED assembly 20 may be housed between the thumb turn wheel outer 39 and the thumb turn wheel inner 40 and may comprise one or more LEDs for providing illumination through or past parts of the thumb turn wheel outer 39 to thereby reflect on the front cover 9. For example, the thumb turn wheel inner 40 may be formed of translucent or transparent material and the LED illumination may be refracted through the thumb turn wheel inner 40 onto a face of the cover 9 so as to generate the impression of an annular illuminated 'ring' on the front cover 9 around the thumb turn wheel 12. The LEDs may receive electric power from the batteries 11. The spring 41 may enable the thumb turn wheel outer 39 (and the button 14) to be depressed relative to the thumb turn wheel inner 40 and the PCB-mounted switch 19 of the LED assembly 20 so as to enable push button actuation of the PCB-mounted switch 19 and thereby enable actuation of various functions of the smart lock 1.

Figure 11:
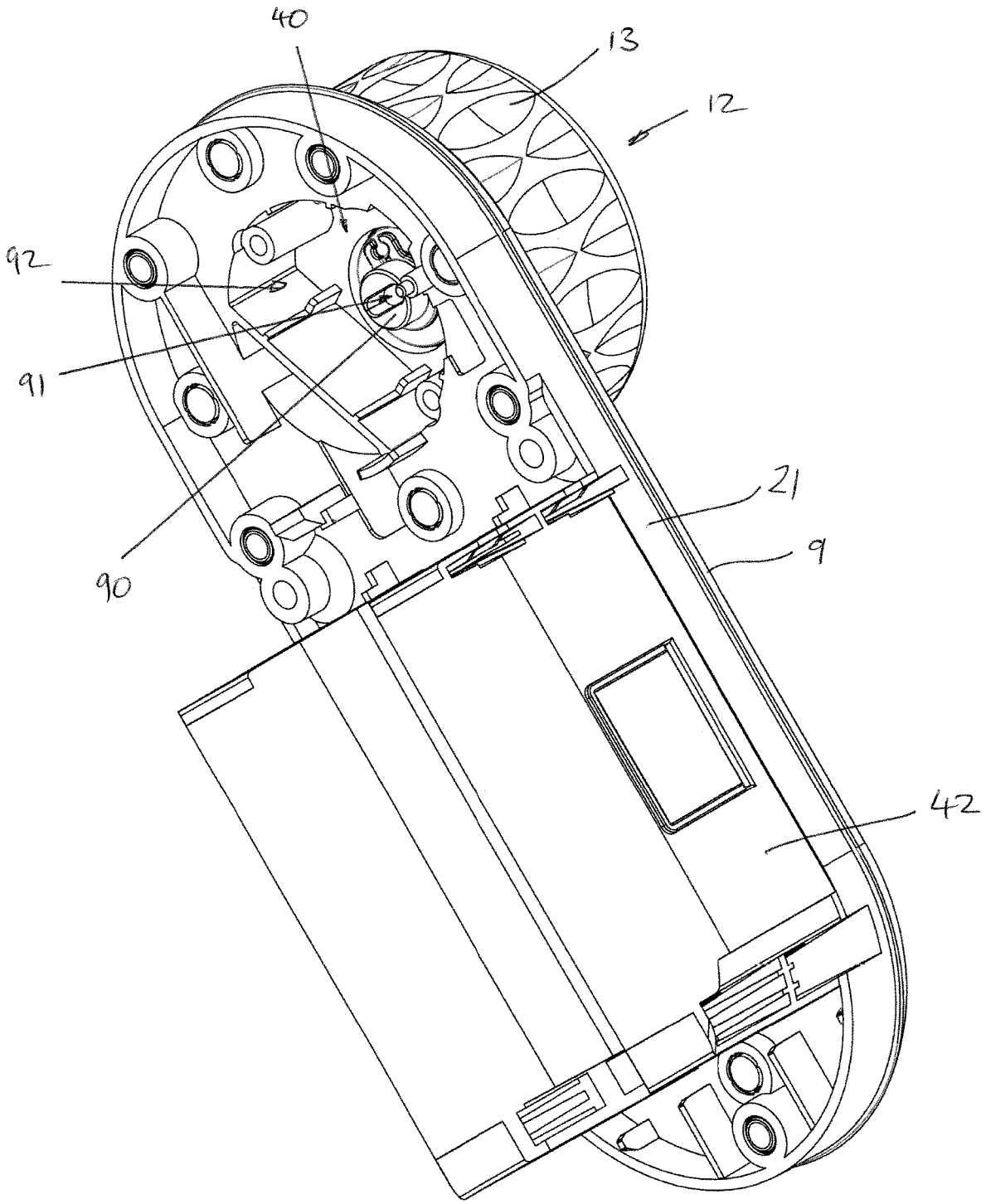
FIG. 11 is a perspective view of a portion of the smart lock of FIG. 1.

As shown in FIG. 13, the thumb turn wheel inner 40 may be mounted to a projection on the battery housing 21 and the battery housing 21 may in turn be securely mounted to the main body 8 of the smart lock 1. As shown in FIG. 11, when the thumb turn wheel 12 is assembled to the battery housing 21, the inner end of the spigot 90 may project through an aperture in the battery housing 21 such that the keyway 91 may be exposed into a recess 92 which may receive on assembly the gear transmission assembly 22 as shown in FIG. 12.

Figure 12:
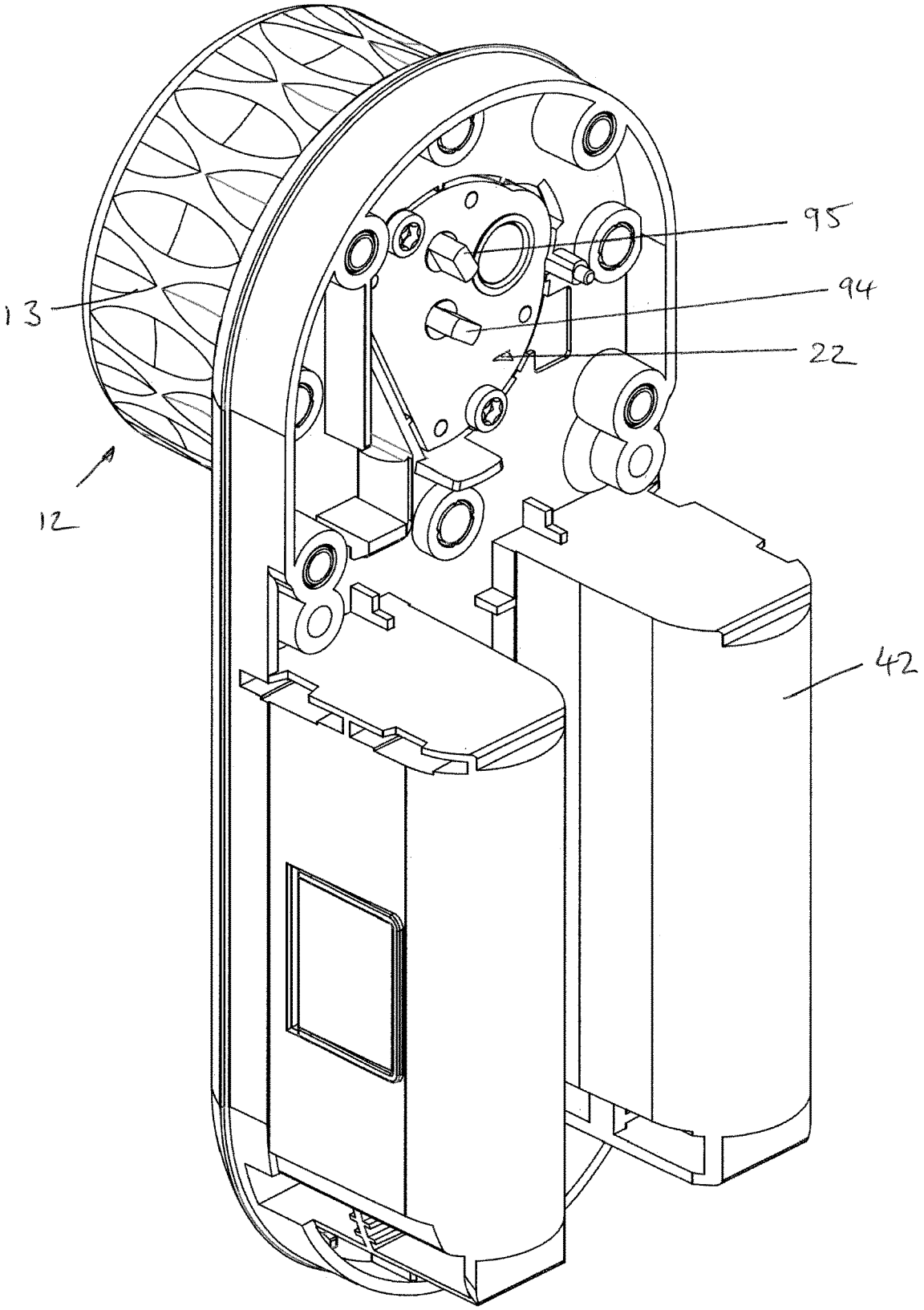
FIG. 12 is a perspective view of the portion of FIG. 11 from another angle together with a geared transmission assembly assembled therewith.

As shown in FIGS. 12 and 13, the gear transmission assembly 22 may comprise a first peg 94 and a second peg 95. The first peg 94 and the second peg 95 may be mounted parallel to one another and off set from one another such that the axes of rotation of the first peg 94 and the second peg 95 may both be parallel to the axis of rotation of the thumb turn wheel 12. The axis of rotation of the first peg 94 may be coincident with the axis of rotation of the thumb turn wheel 12. In addition, the geared transmission assembly 22 may comprise a plurality of gears 96 which rotatively couple the first peg 94 to the second peg 95. Preferably, a 1:1 gear ratio between the first peg 94 and the second peg 95 is provided such that on rotation of the first peg 94, the second peg 95 is configured to rotate in the same sense and at the same rotational speed. To enable this, the plurality of gears 96 may comprise a first gear wheel which may comprise gear teeth provided on a periphery of the first peg 94, a second gear wheel which may comprise gear teeth provided on a periphery of the second peg 95 and an idler gear that meshes between the first gear wheel and the second gear wheel. As shown in FIG. 13, an outer end of the first peg 94 may be provided with a slot shaped projection sized and dimensioned to be received within the keyway 91 of the spigot 90. The outer end of the first peg 94 may thus form an input shaft for receiving torque from the thumb turn wheel 12. As shown in FIG. 12, the inner ends of the first peg 94 and the second peg 95 may be provided with slot shaped projections, which may form output shafts, the use of which will be described further below.

The smart lock 1 may further be provided with means for determining the degree and rotational direction of movement of the drive train. This means may comprise the provision of complimentary magnetic means and sensing means. In one example one or more magnets may be provided on, in, or coupled to the geared transmission assembly 22 such that the one or more magnets are driven to rotate in sync with rotation of the first peg 94. The sensing means may be located in proximity to the geared transmission assembly 22 to sense the direction of rotation of the first peg 94 and the angular degree of revolution by sensing the varying magnetic field of the moving magnetic means. The sensing means may be operatively connected to the processing means of the PCB 100 and the smart lock's firmware may utilise the sensed data to establish, directly or by inference, the direction of rotation, speed of rotation, angular distance of rotation and/or duration of rotation. For example, the sensing means may be an IC chip mounted on the PCB 100. In one example, the magnetic means may be a BMN 35H diametral magnetised magnet with a 5 degree angle deviation tolerance that is coupled to rotate together with the idler gear of the geared transmission assembly 22. The sensing means may be a Hall-effect sensor or sensor array that, preferably, is formed as an IC mounted to a portion of the PCB 100 that extends beneath the location of the geared transmission assembly 22. The BMN 35H magnet may be suitably magnetised to produce a varying magnetic field at the location of the Hall-effect sensor or sensor array on rotation of the first peg 94 which is coupled to the idler gear.

Figure 8:
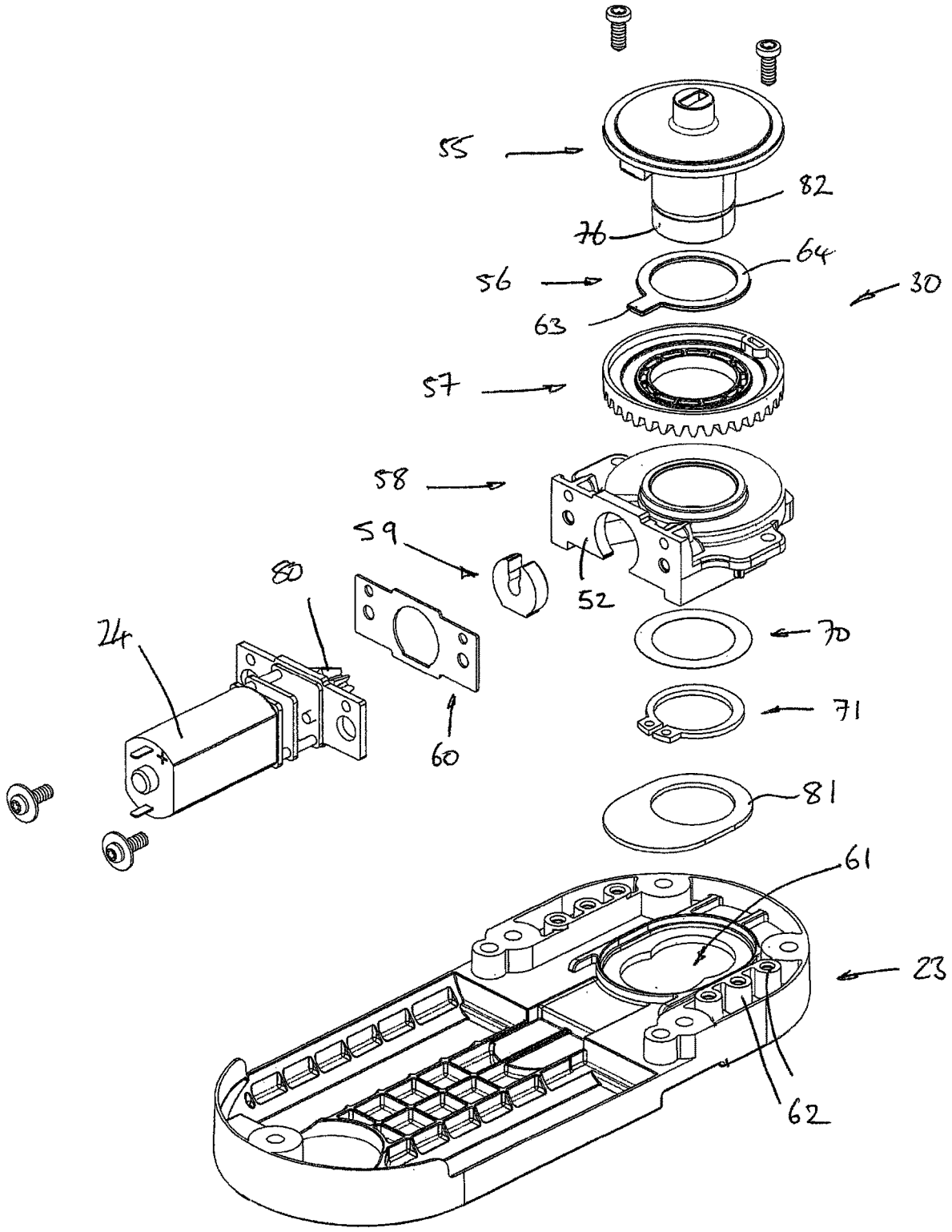
FIG. 8 is an exploded perspective view of a portion of the smart lock of FIG. 1.
Figure 9:
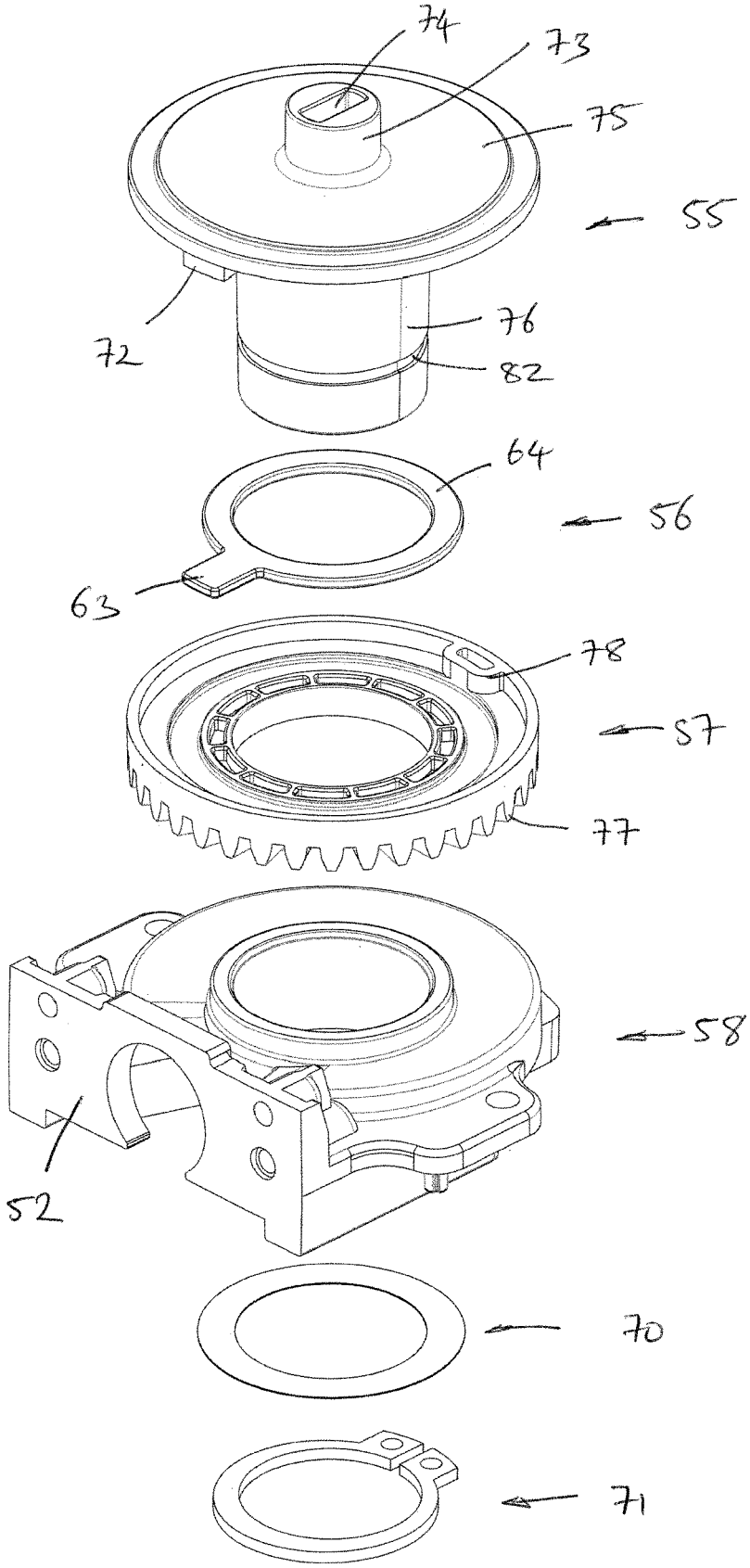
FIG. 9 is an exploded perspective view of a clutch assembly of the smart lock of FIG. 1.
Figure 10:
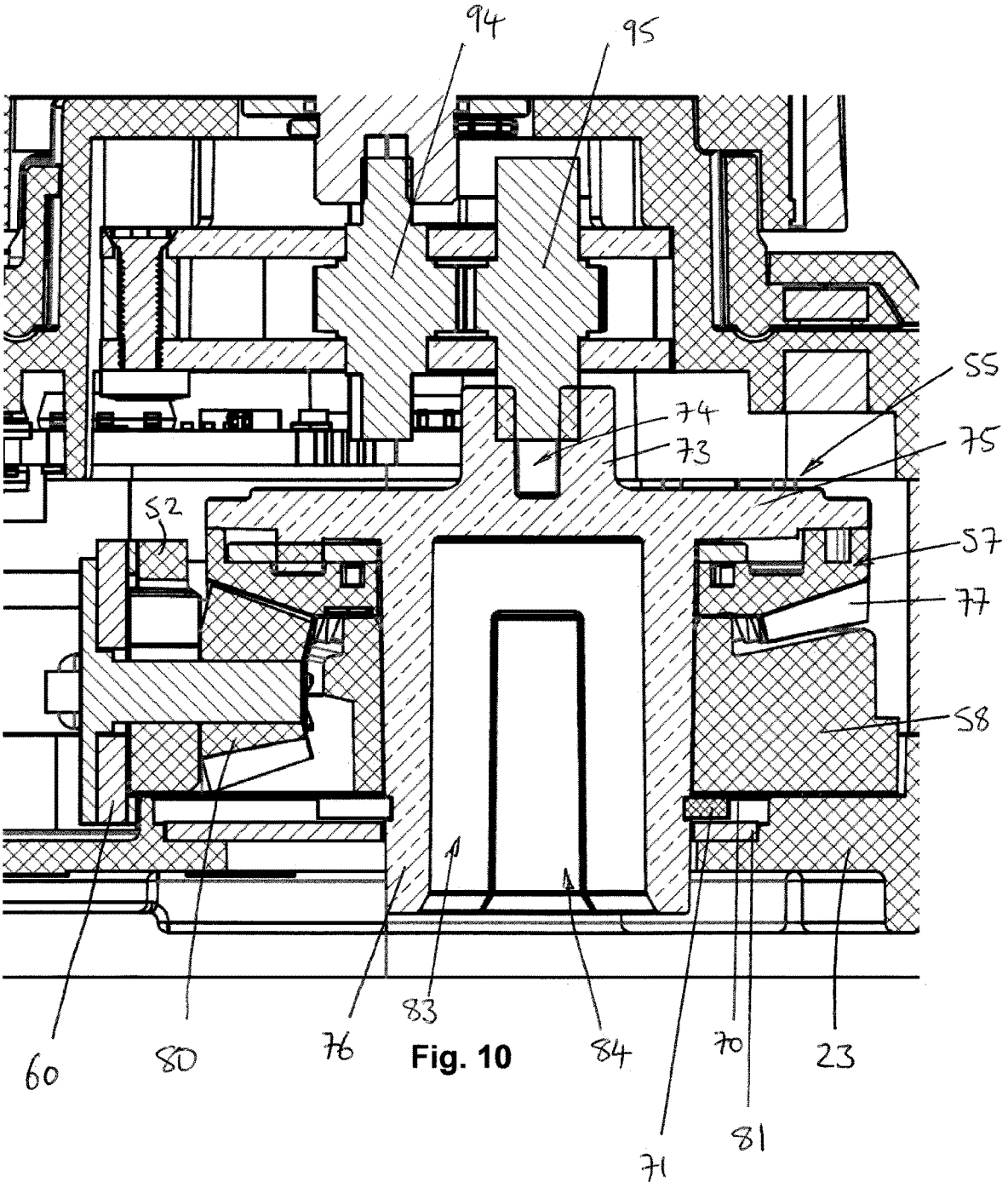
FIG. 10 is a sectioned view of a portion of the smart lock of FIG. 1.

The clutch assembly 30 of the smart lock 1 is shown in more detail in FIGS. 9 and 10. The clutch assembly 30 may comprise a clutch body 55, a clutch 56, a bevel gear 57 and a clutch chassis 58. The components of the clutch assembly 30 may be assembled together and mounted to the motor carriage 23 as shown in FIG. 8 together with the motor 24. The clutch body 55, clutch 56 and bevel gear 57 may be mounted concentrically. The motor 24 may be an electric motor. The motor 24 may receive electric power from the batteries 11. An output shaft of the motor 24 may be coupled to a pinion gear 80 which is configured to couple to the bevel gear 57 of the clutch assembly 30. As can be seen in FIG. 8, the axis of rotation of the output shaft of the motor 24 may be perpendicular to the rotational axis of the clutch assembly 30 (including the bevel gear 57).

The clutch body 55 may comprise a circular flange 75 and a spigot 73 which projects outwardly from the flange 75. An outer end of the spigot 73 may be provided with a key hole slot 74. The clutch body 55 may further comprise on an opposite side of the flange 75 from the spigot 73 a cylindrical extension 76. As shown in FIG. 10, the cylindrical extension 76 may be closed at an outer end by the flange 75 but may be open at an inner end and may define a bore 83 which may be generally circular but is preferably provided with two axially orientated keyed slots 84 that may be located on opposed points of the bore 83.

Further, an outer surface of the cylindrical extension 76 may be provided with an annular recess 82. Further, an inner face of the flange 75 may be provided with a contact block 72 as shown in FIG. 9, the use of which will be described further below.

The clutch 56 may comprise a clutch ring 64 and a clutch tab 63 which may extend radially outwardly from the clutch ring 64.

The bevel gear 57 may comprise a plurality of gear teeth 77 upon its inner face. On the opposite outer face of the bevel gear 57 a recess may be provided in which can be received the clutch 56. A contact block 78 may be provided within the recess at the periphery of the bevel gear 57.

The clutch chassis 58 may be provided with means for coupling the clutch chassis 58 to the motor carriage 23 which may be in the form of screw or bolt holes. In addition, a mounting frame 52 may be provided to which the motor 24 can be connected. The clutch chassis 58 may be provided with an aperture to enable the cylindrical extension 76 of the clutch body 55 to project therethrough.

As shown in FIG. 8, the motor carriage 23 may be provided with an aperture 61 through which the cylindrical extension 76 may project. The aperture 61 may be shaped in the form of two circular apertures that are overlapping one another to result in an aperture in the form of a "figure of eight" shape. This may enable the cylindrical extension 76 to be located in first or second locations within the aperture 61 as will be described further below. The motor carriage 23 may be further provided with a plurality of mounting bosses 62. As shown in the example, three mounting bosses 62 may be provided on each side of the aperture 61. The aperture 61 may take other shapes. In another example, the aperture may take the form of a slot shape so that multiple positons could be selected, with the location of the cylindrical extension 76 within the slot being selected by the provision of a plurality of the mounting bosses 62 extending along the length of the slot.

As shown in FIG. 8, other fixing components may be provided to enable optimum assembly of the clutch assembly 30 and the motor 24 with the motor carriage 23. For example, a retainer 59 and plate 60 may be interposed between the motor 24 and the mounting frame 52 of the clutch chassis 58. Further, a blanking plate 81 may be provided between the motor carriage 23 and the clutch chassis 58. The blanking plate 81 may be reversible and may comprise a circular aperture sized to permit the cylindrical extension 76 to project therethrough. Thus, dependent on which portion of the aperture 61 is chosen for the location of the cylindrical extension 76, the blanking plate 81 may be used to blank off the remaining, unoccupied, portion of the aperture 61. In addition, a washer 70 and circlip 71 may be provided beneath the clutch chassis 58 to retain the clutch body 55 to the clutch chassis 58 by engagement of the circlip 71 in the annular recess 82.

Figure 14:
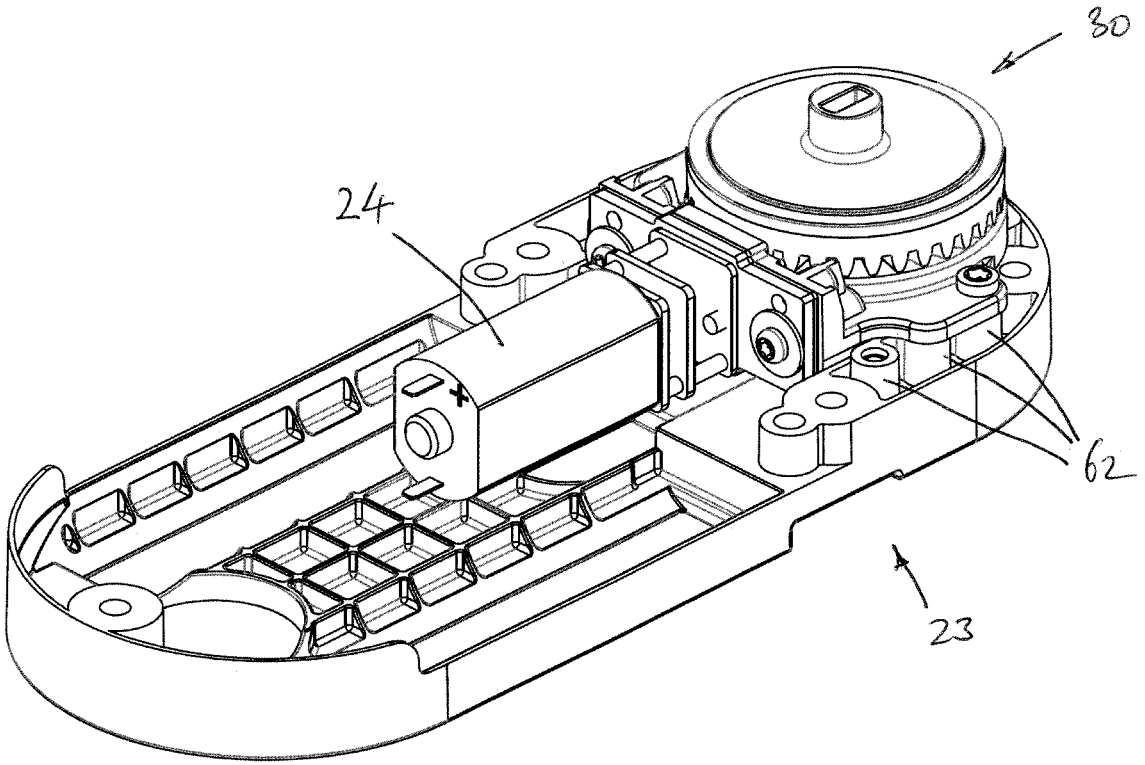
FIG. 14 are perspective views of the motor and clutch assembly of the smart lock of FIG. 1 mounted to a motor carriage of the smart lock in a first and second position.
Figure 14:
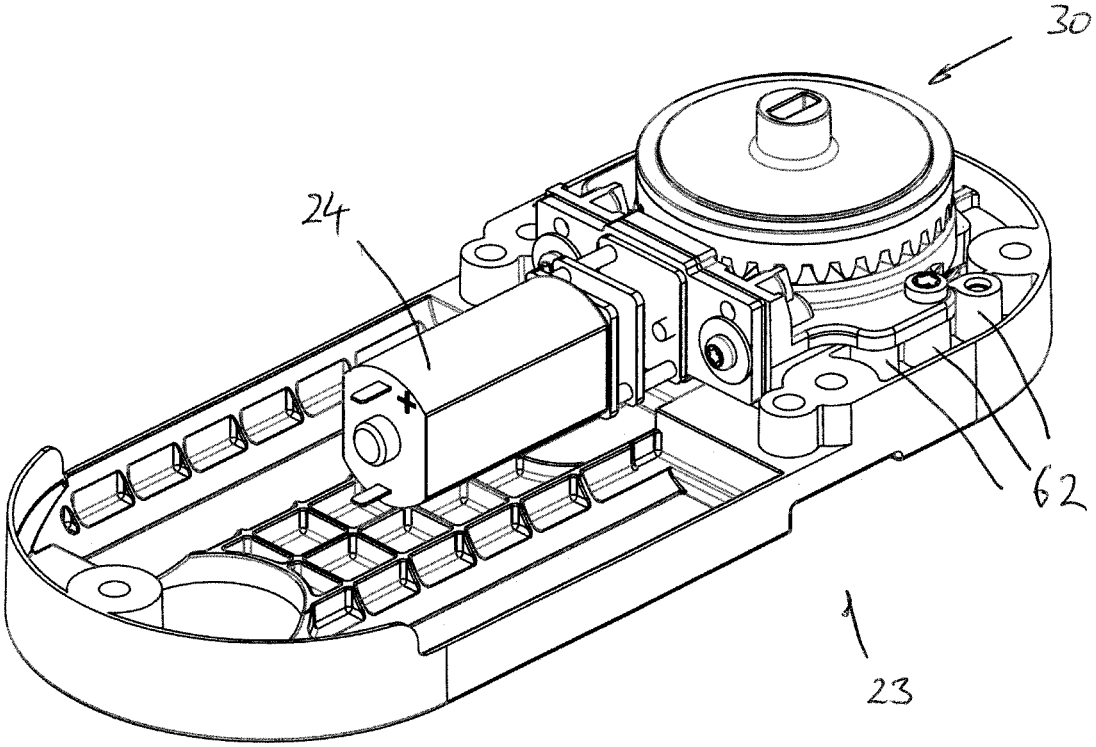
Figure 15:
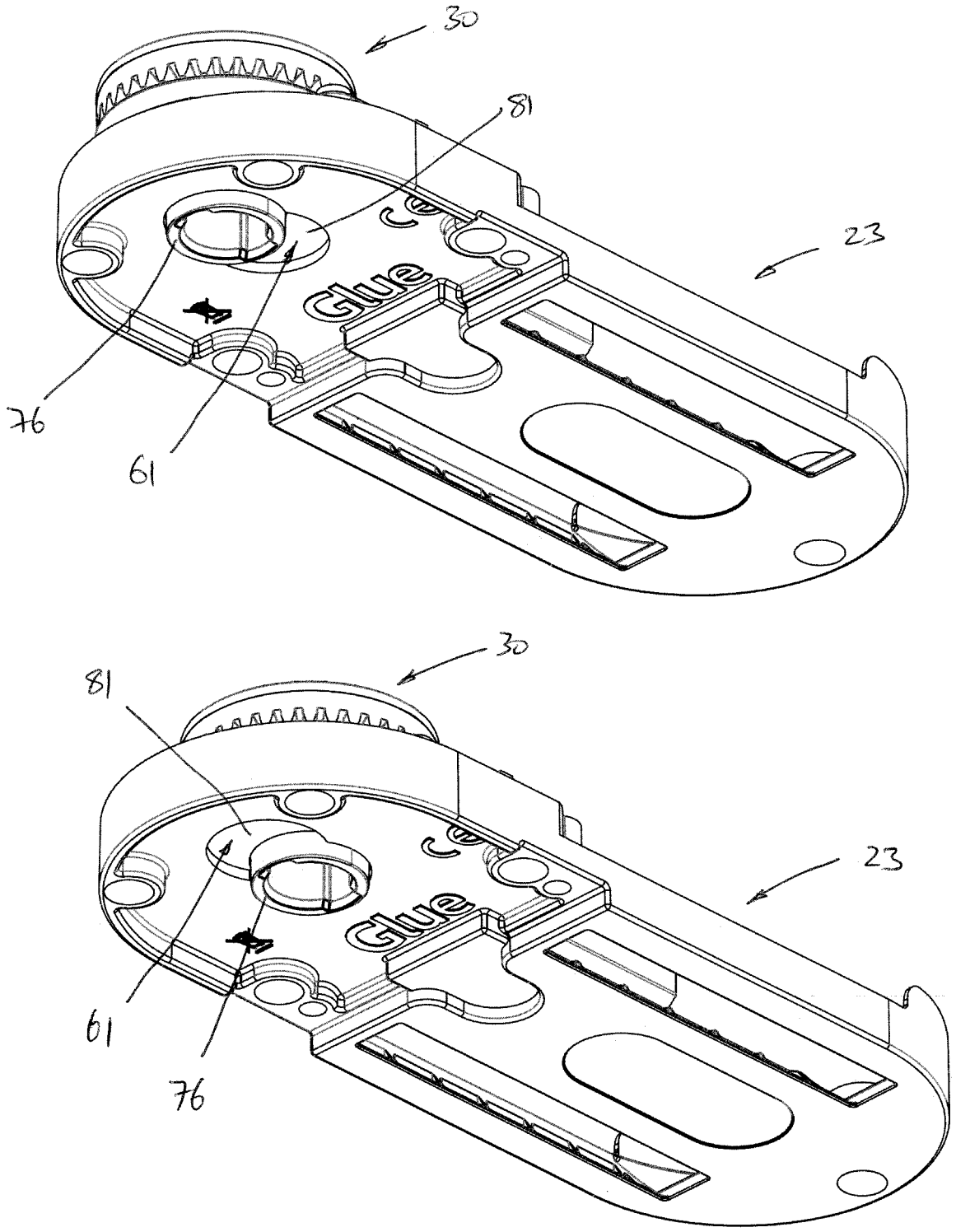
FIG. 15 are perspective views of the portions of FIG. 14 from another angle.

FIGS. 14 and 15 illustrate the clutch assembly 30 and motor 24 assembled together and mounted to the motor carriage 23. An upper portion of each Figure illustrates the clutch assembly 30 mounted in the first location and the lower portion of each Figure shows the clutch assembly 30 mounted in the second location. As most clearly shown in FIG. 15, in the first location, the cylindrical extension 76 projects through one end of the aperture 61 with the remaining portion of the aperture 61 closed off by the blanking plate 81. In the second location the cylindrical extension 76 projects through the other end of the aperture 61 and, again, the blanking plate 81 seals off the remainder of the aperture 61. As shown most clearly in FIG. 14, the plural mounting bosses 62 of the motor carriage 23 allow for fixedly retaining the clutch chassis 58 in either the first or second location. For example, with the clutch assembly 30 in the first location, fixtures such as screws or bolts may be engaged in the endmost mounting boss 62 on each side of the motor carriage 23. In the second location, the fixtures may be located into the middle mounting boss 62 as illustrated. It will be readily apparent that other configurations are possible. In particular, other shapes of aperture 61 may be provided that enable more than two locations for the cylindrical extension 76. Likewise, additional mounting bosses 62 may be provided to enable additional mounting locations for the clutch assembly 30.

To assemble the smart lock 1, the clutch assembly 30 and motor 24 may first be assembled to the motor carriage 23 to form a sub-assembly which may then be mounted to the main body 8 using suitable fixtures such as screws or bolts. As shown in FIG. 10, the clutch assembly 30 may itself be assembled by stacking and inserting the clutch body 55, clutch 56 and bevel gear 57 into the clutch chassis 58. The washer 70 may also be coupled and the assembly retained by attaching the circlip 71 into the annular recess 82. The output shaft and pinion gear 80 of the motor 24 may be coupled through the side of the clutch chassis 58 such that the gear teeth of the pinion gear 80 mesh with the gear teeth 77 of the bevel gear 57. On assembly and mounting to the motor carriage 23, the blanking plate 81 may be suitably orientated depending on the portion of the aperture 61 through which the cylindrical extension 76 projects.

As shown in FIGS. 12 and 13, the front cover 9 and thumb turn wheel 12 may be assembled on to the battery housing 21 which is then itself secured onto the main body 8 by suitable fixtures such as screws or bolts. As shown in FIG. 13, on assembly, the keyway 91 in the end of the spigot 90 of the thumb turn wheel inner 40 may be received on the outer end of the first peg 94.

In the example of FIG. 13, the key hole 74 of the spigot 73 of the clutch body 55 is received on the inner end of the second peg 95 which equates to the clutch assembly 30 being mounted in the first location on the motor carriage 23 as shown in the top part of FIGS. 14 and 15. Depending on the mounting location of the clutch assembly 30 on the motor carriage 23 the key hole 74 of the spigot 73 may be received on the inner end of the first peg 94. The inner end of the first peg 94 and the inner end of the second peg 95 may both form output shafts of the geared transmission assembly 22 for supplying torque to the clutch body 55.

The vibration isolator 27 can then be affixed to the outer face of the motor carriage 23 and the smart lock 1 is then ready for assembly to the insert 25 and mounting plate 26.

When fixing the smart lock 1 to the door 5, the appropriate mounting plate 26 and insert 25 is chosen. The insert 25 comprises a cylindrical element having a bore. The bore may preferably have the same cross-sectional shape along its length or may have a different cross sectional shape at one end to the other. The insert 25 may be also provided with two longitudinal ribs that extend outwardly from its cylindrical body. The ribs may be shaped to be received within the keyed slots 84 of the cylindrical extension 76. The shape of the bore within each insert 25 may be configured to match the shape of a lock tailpiece 105, 106. For example, a first insert 25 may have a bore shaped to receive the first lock tailpiece 105 and a second insert 25 may have a bore shaped to receive the second lock tailpiece 106.

To install and mount the smart lock 1 to the closure 5, a user may use the pre-existing lock tailpiece 105, 106 of the closure 5 if compatible. If not, a replacement lock tailpiece 105, 106 may first be installed into the closure 5. Thus, installation may involve replacing the pre-existing lock mechanism or a part of the lock mechanism of closure 5. Typically where the lock mechanism in the closure 5 comprises a Euro-cylinder, the replacement lock tailpiece 105 will be needed (which may include an integrated cylinder) as Euro-cylinders are not typically configured with extended tailpieces. The correct mounting plate 26 is then chosen and mounted to the closure 5 using suitable fixtures such as screws or bolts and mounting apertures 49. The required insert 25 may then be mounted over the lock tailpiece 105, 106. At this point, a remainder of the smart lock 1 may be mounted to the door 5 with the end of the insert 25 being received within the bore 83 of the cylindrical extension 76 such that the ribs of the insert 25 are received within the keyed slots 84.

The body 8 of the smart lock 1 may then be fixedly retained to the mounting plate 26 by use of fixtures such as long bolts or screws 16 that pass through mounting bosses of the body 8 and the additional mounting apertures 44 of the mounting plate 26. Access to install or remove the long bolts or screws 16 may be achieved by rotation of the front cover 9. Thus, the user does not need to dismantle other parts of the smart lock 1 in order to install or remove the smart lock 1 to or from the mounting plate 26.

In use, the smart lock 1 may be used in a variety of modes for operating the lock mechanism of the closure 5. In a first mode the lock mechanism may be actuated by manual rotation of the thumb turn wheel 12. In this mode, rotation of the thumb turn wheel outer 39 rotates the integral spigot 90 which rotates, as shown in FIG. 13, the first peg 94. This then rotates the plurality of gears 96 of the geared transmission assembly 22 causing the second peg 95 to rotate and with it the attached clutch body 55. In turn the clutch body 55 may drive rotation of the insert 25 and the connected lock tailpiece 105, 106. Due to the nature of the clutch assembly 30, manual rotation of the clutch body 55 can initially take place without corresponding rotation of the bevel gear 57 because the starting location of the contact block 72 is displaced from both the clutch tab 63 of the clutch 56 and the contact block 78 of the bevel gear 57. Rotation of the clutch body 55 will first bring the contact block 72 into contact with clutch tab 63 allowing torque to be transmitted from the clutch body 55 to the clutch 56. Thereafter, both will rotate together until they contact the contact block 78. At this point, further rotation manually of the clutch body 55 is prevented because the bevel gear 57 is prevented from rotating relative to the clutch chassis 58 due to engagement of the teeth 77 with the pinion gear 80. This mechanism may allow a significant degree of manual rotation of the clutch body 55 to be achieved. For example, up to 700° of rotation may be accommodated before the thumb turn wheel rotation will engage the motor pinion gear. Rotation of the clutch body 55 may lead to corresponding rotation of the cylindrical extension 76 and of the insert 25 received therein. Rotation of the insert 25 leads to corresponding rotation of the pre-existing or replacement tailpiece 105, 106 leading to operation of the mechanism of the closure 5. Thus, in this mode the thumb turn wheel 12 may allow for manual operation of the lock mechanism by driving under manual force the drive train (or at least a part of the drive train) of the smart lock 1.

In a second mode, the smart lock 1 may be operated by engagement of a key in the opposite side of the closure 5 i.e. by operation of the lock mechanism from the other side of the closure to which the smart lock 1 is mounted. Operation of the lock mechanism in the normal manner leads to rotation of the tailpiece 105 and rotation of the insert 25 which is mounted thereto. This leads to rotation of the clutch body 55 which is free to rotate relative to the clutch chassis 58 as described above. This does not engage the motor 24 whilst doing so.

The third mode of operation is where the smart lock 1 may be operated by the prime mover which may be in the form of the motor 24. This mode may be used when the smart lock 1 is activated either by receipt of the receiver of the PCB 100 of wireless commands or by input of commands using the button 14 of the thumb turn wheel 12. In this mode, actuation of the motor 24 leads to rotation of its output shaft and the pinion gear 80 mounted thereto. Rotation of the pinion gear 80 leads to rotation of the bevel gear 57. Rotation of the contact block 78 of the bevel gear 57 brings the contact block 78 into contact with the clutch tab 63 allowing torque to be transmitted from the bevel gear 57 to the clutch 56. Thereafter, the contact block 78 and/or the clutch tab 63 may be rotated into contact with the contact block 72 of the clutch body 55 allowing torque to be transmitted from the clutch 56 to the clutch body 55. As described above, rotation of the clutch body 55 leads to rotation of the insert 25 and the attached tailpiece 105 and operation of the lock mechanism of the closure. Thus, in this mode the motor 24 may allow for powered operation of the lock mechanism by driving the drive train (or at least a part of the drive train) of the smart lock 1.

During installation the smart lock 1 may be calibrated by the user by rotating the thumb turn wheel 12 in to a series of orientations and these positions are stored by the smart lock's internal memory. This then indicates to the smart lock 1 the type of door lock mechanism the smart lock 1 is interacting with and the smart lock's internal control system (firmware) can then control the lock mechanism appropriately. This enables the smart lock 1 to be compatible with a wider range of door lock configurations.

This calibration control system may include the start and stop position of rotation of the thumb turn wheel 12 to carry out a command, the angular distance (for example in degrees) and duration (for example in seconds) of rotation, any positions that pauses in rotation are required and any "neutral position" that the lock should return to after the command has been carried out. This enables the smart lock 1 to be compatible with a wider range of door lock mechanisms.

The calibration may be carried out in conjunction with the external app.

In one example of calibration, the thumb turn wheel 12 is first turned to the fully locked position and then to the fully unlocked position (or vice versa). The smart lock 1 may use a combination of the complimentary magnetic means and sensing means described above provided on, in, or coupled to the gearbox transmission assembly 22 and "over current sensing" of the motor 24 to program the smart lock's firmware as to which position is locked and unlocked. The firmware then subsequently controls the motor 24 to turn the pinion gear 80 in the correct direction of rotation to the appropriate degree to actuate a user command inputted via the button 14 of via the external app.

As noted above, the clutch assembly 30 may be mounted to the motor carriage 23 in at least two locations. In the illustrated embodiment of FIG. 13, the first peg 95 is engaged with the spigot 73 of the clutch body 55. Where the clutch assembly is mounted in the other location on the motor carriage 23, the spigot 73 will be engaged on the end of the first peg 94 and will be rotated directly by rotation of the first peg 94. In this mode of operation the second peg 95 can continue to rotate freely but is not used as part of the drive train.

Figure 16:
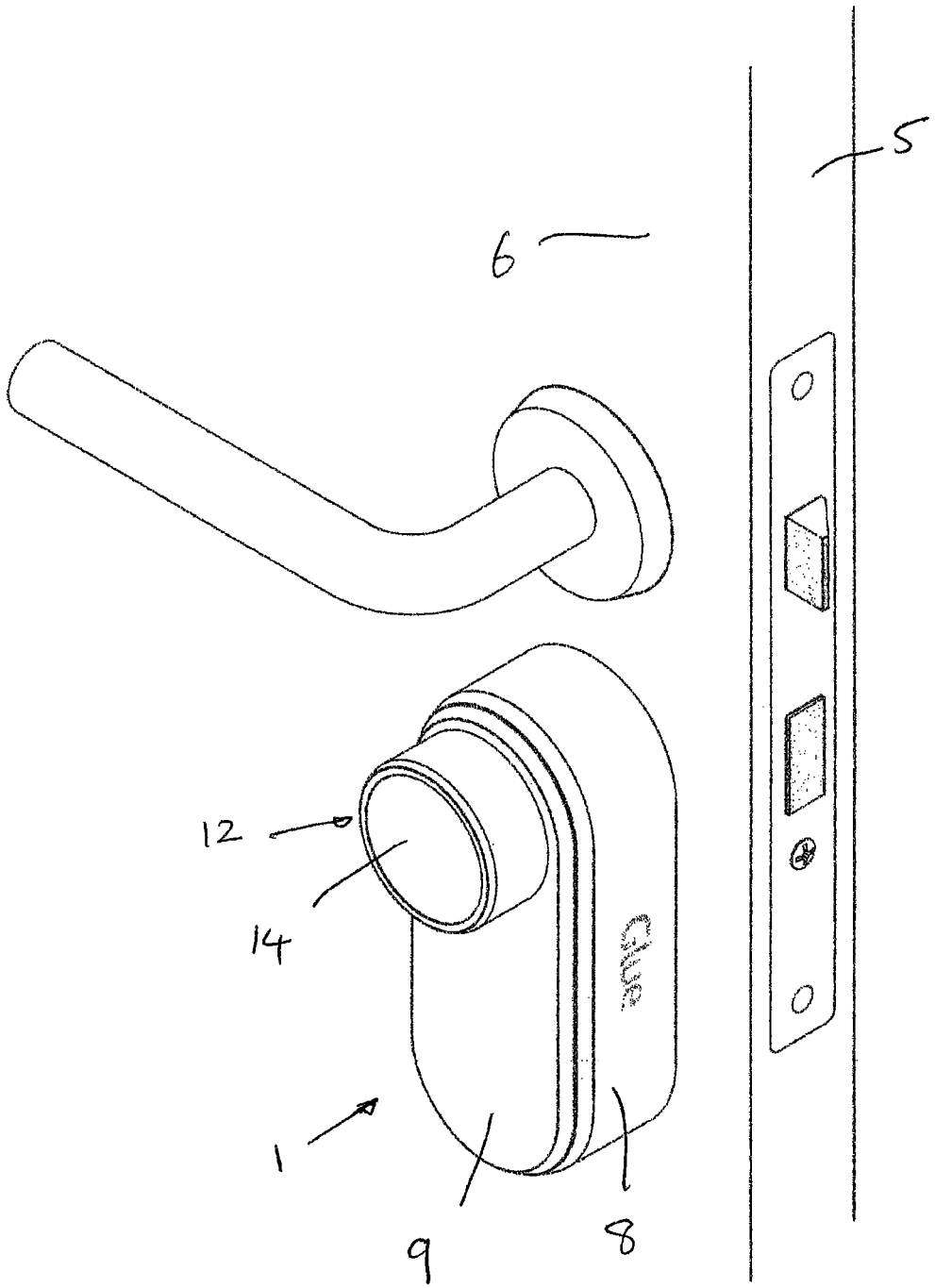
FIG. 16 is an illustration of the smart lock of FIG. 1 installed on a swing door.
Figure 17:
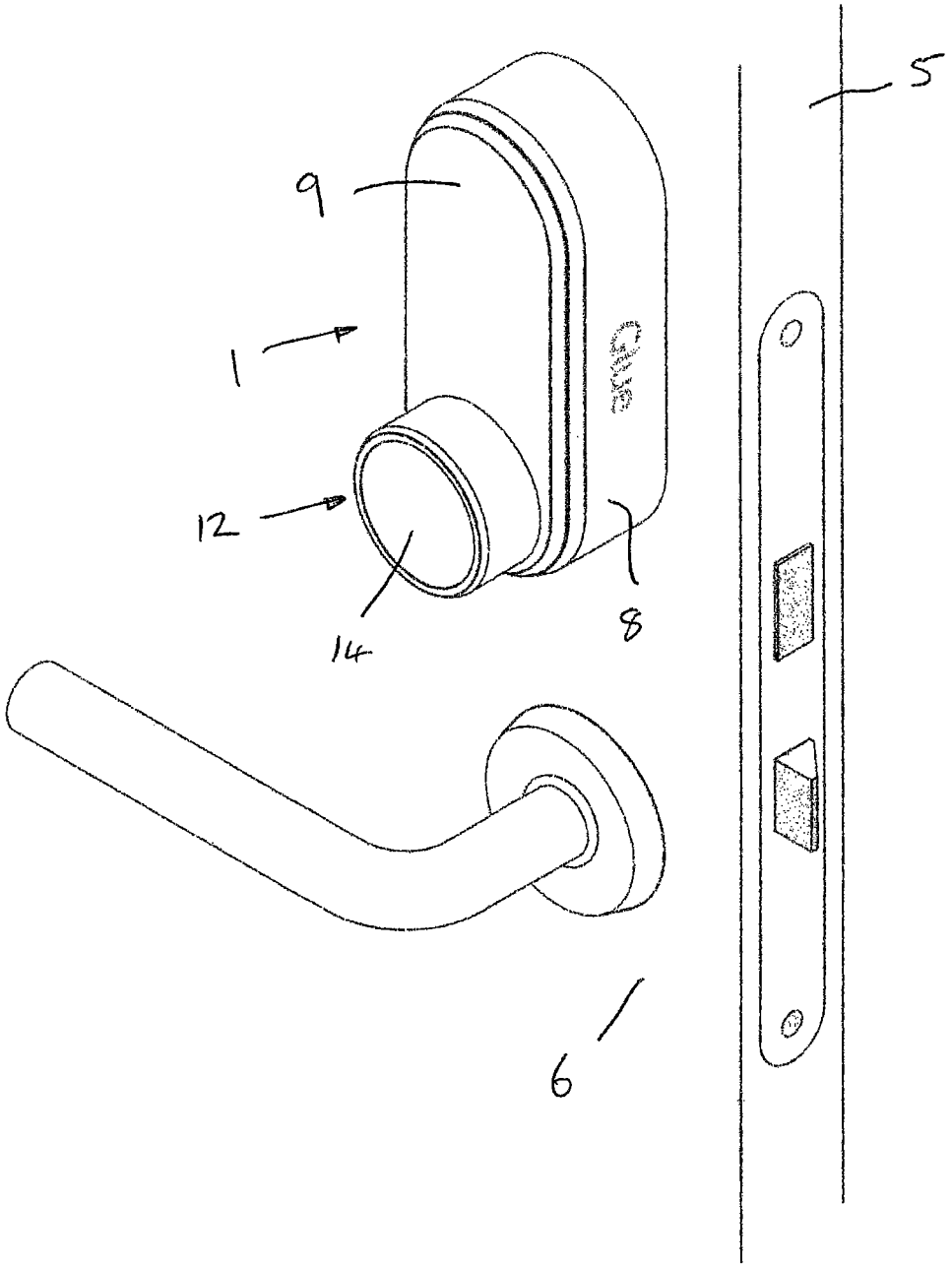
FIG. 17 is an illustration of the smart lock of FIG. 1 installed on another swing door in an alternative configuration.

As shown in FIGS. 16 to 18, the smart lock 1 may be installed on the door 5 in different orientations, for example either way up. This increases the flexibility of the smart lock 1 and allows it to be installed on a wider range of doors.

The smart lock 1 communicates with the smart phone app via the hub 2. Communication between the smart lock 1 and the hub 2 may be by Bluetooth or Wi-Fi or a combination thereof. Preferably the communication uses Bluetooth low energy (BLE) communication. In one example, the smart lock 1 and hub 2 may comprise BLE chip sets.

For example, suitable chipsets are available from Nordic Semiconductor, Oslo, Norway, including the nRF52 Series chipsets. In one example, the smart lock 1 and hub 2 may comprise Wi-Fi chipsets. For example, a suitable chipset is the BCM43362 from Cypress Semiconductor, San Jose, USA.

Secure encrypted server single use digital keys may be used to operate the smart lock 1. The smart lock 1 app control may uses a unique system that allows use when the user's device running the app (e.g. mobile phone) is not online or connected to a mobile network. The smart lock 1 operation may utilise a system with one-time digitally encrypted keys that may allow for one lock control operation (lock or unlock) each. The user's device may download and store a limited number of single use digital keys, for example five, so that if the app is offline the user can control the lock for a limited number of single actuations. The app may be configured to replenish the store of single use digital keys once the app is back online again.

The hub 2 may be a Bluetooth and/or Wi-Fi bridge. This permits the smart lock 1 to be communicated with directly (for example by Bluetooth) as well as via the hub 2 (for example by Bluetooth or Wi-Fi).

The app may provide additional functionality. The app may allow a user to manage 'key' ownership to allow access through the door 5 in a flexible and varied manner. Using secure back end servers with bank grade encryption, one can enable:

one off access;

access limited to certain times; and ongoing access.

The 'keys' can be retracted/deactivated by the user at any time. Such an ecosystem may advantageously improve the logistics of third parties wishing to access the door 5. For example, this can include benefits to service partners such as delivery companies, domestic service and maintenance operators. Distribution and deliveries may also have reduced environmental impact, as they can be scheduled with the most efficient, time and fuel efficient routes since access through the door 5 on arrival will be guaranteed by operation of the smart lock 1.

The ecosystem provided by the smart lock 1, hub 2 and app may comprise an app dashboard that, for example, lets a user know that the batteries 11 have been successfully replaced; that a dog walker has arrived and subsequently dropped him home again an hour later; remind you that a plumber is scheduled for tomorrow afternoon and they will have one off access for 30 minutes to fix the leaking tap in time for your weekend guests to arrive.

The smart lock 1, hub 2 and app permit controlled, secure access through closures, for example, the front door of a domestic residence, to trusted people and with that, change the way users live. The ecosystem enables a user to visualise, manage and control the comings and goings in their home. In addition, ecosystem will allow a 'digital home concierge' facility—as one arrives home, the smart lock 1 recognises the user (for example by Bluetooth and or Wi-Fi communication) and unlocks, so there is no wrestling with bags and keys. In another example a user will find parcel deliveries safely in their house since the delivery company has been provided with scheduled access.

Advantageously, the door 5 may still be opened by operating the lock from the exterior using a physical key or manually from the inside by turning the thumb turn wheel 12 if the user chooses.

Figure 19:
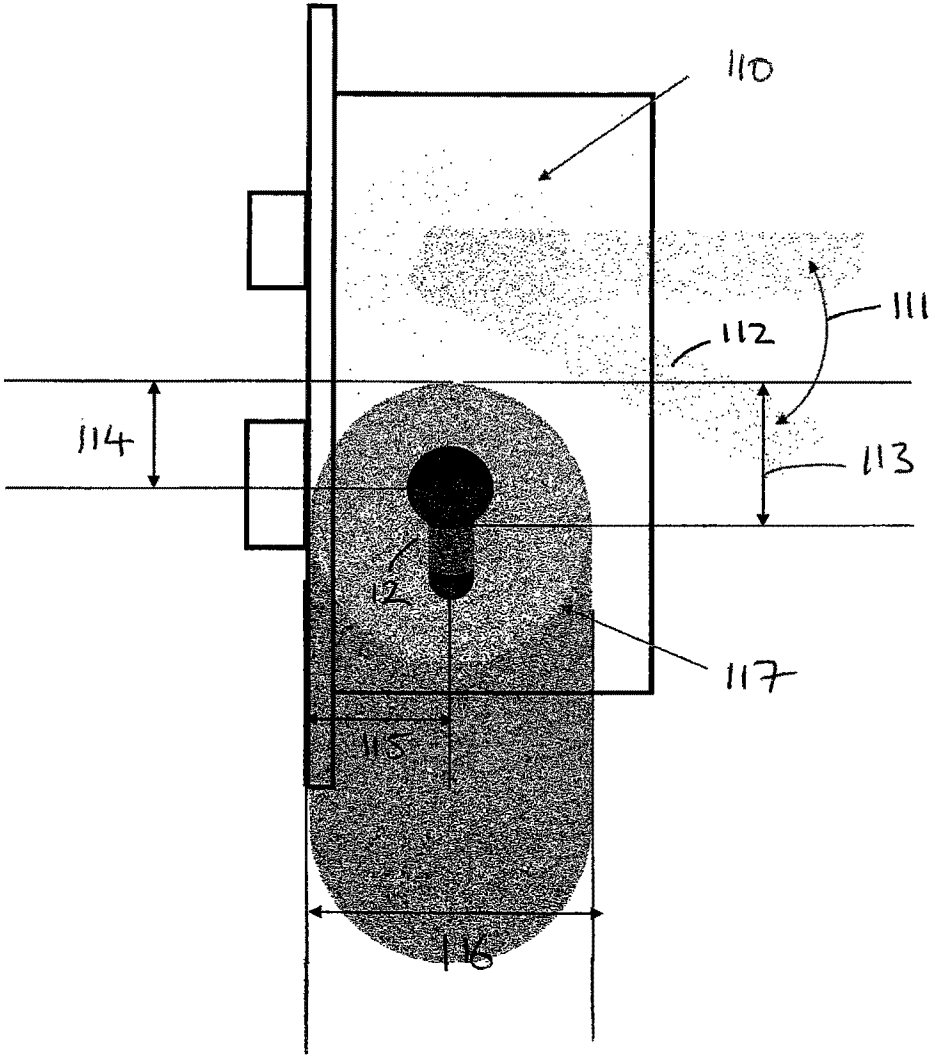
FIG. 19 is a schematic diagram illustrating various dimensions of the smart lock.

Advantageously, the smart lock 1 may be of a physical size that permits it to be fitted to a wide range of existing lock mechanisms that are found in different countries. As shown in FIG. 19, the size of the smart lock 1 takes into account the constraints given by the smallest and largest Euro-cylinder lock back sets. In addition, the constraint that the main housing 8 cover the size of the large hole that needs to be cut in doors that contain a lock mechanism with deadbolt is satisfied. Deadbolts are more common in the US, Canada, Caribbean and South America. Further, the smart lock 1 size may need to accommodate the most common sizes of door handle and rose geometry. As shown in FIG. 19, the constraints may include:

the size of the handle rose 110 that may be 50-52 mm in diameter;

an angular degree of rotation 111 of the handle 112 that may be up to 35 degrees;

a minimum distance 113 from an end of the smart lock 1 to the axis of rotation of the thumb turn wheel 12 of 28 mm to allow for fitting to lock mechanisms having standard deadbolts;

a maximum distance 114 from the end of the smart lock 1 to a central axis of the Euro-cylinder of 21 mm to allow for fitting to lock mechanisms having Euro-cylinder lock mechanisms so as to clear the largest typical handle rose 110;

a maximum half-width 115 of the smart lock 1 of 30 mm to accommodate the smallest Euro back-set diameter; and a minimum total width 116 of the smart lock 1 of 56 mm to cover the largest typical deadbolt hole 117.

In one example, the smart lock 1 may be 56.8 mm wide, 131 mm high and 56.10 mm deep from the door 5. The product may weigh approximately 300 g.

The invention claimed is:

1. A smart lock for securing a closure, the smart lock comprising:

an actuator configured to actuate a lock mechanism contained within the closure to secure and/or to release the lock mechanism; and a receiver configured to wirelessly receive a signal to control operation of the actuator;

wherein the actuator comprises a prime mover and a drive train for transmitting motion of the prime mover to actuate the lock mechanism, wherein the prime mover is an electric motor;

wherein the drive train comprises a thumb turn wheel to allow manual operation of the lock mechanism; and wherein the thumb turn wheel comprises a button configured to actuate the lock mechanism contained within the closure to secure the lock mechanism.

2. The smart lock of claim 1, wherein the receiver is configured to receive a signal from a third party mobile device and to confirm with an external server permission for actuation of the lock mechanism by the third party device, wherein confirmation of permission involves verification of a current time with a permission time.

3. The smart lock of claim 1, wherein the button is configured to actuate the lock mechanism contained within the closure to secure the lock mechanism after a predetermined delay period when pressed twice in succession.

4. The smart lock of claim 1, wherein the smart lock further comprises a housing having a front cover through which the thumb turn wheel projects, and wherein the front cover is pivotally connected to the housing about an axis of rotation of the thumb turn wheel.

5. The smart lock of claim 4, wherein the housing and the front cover each comprise complementary magnets that rotatably retain the front cover in a closed position.

6. The smart lock of claim 4, wherein the housing comprises locations for receiving fixatives configured to fix the smart lock to the closure, and wherein the locations are accessible for installing or removing the fixatives by rotating the cover to an open position.

7. The smart lock of claim 1, wherein the smart lock is retro-fittable to the closure and a shoot bolt of a pre-existing lock of the closure, and wherein the smart lock is retro-fittable to a closure in more than one orientation.

8. The smart lock of claim 1, wherein the smart lock is pairable to a hub by wireless communication, and wherein operation of the smart lock is configurable remotely via the hub.

9. The smart lock of claim 1, wherein the drive train comprises a clutch assembly, wherein the prime mover and the clutch assembly are operatively engaged with each other, wherein the clutch assembly comprises a clutch body, a clutch and a clutch gear, and wherein the clutch body, clutch and clutch gear are mounted concentrically.

10. The smart lock of claim 9, wherein the clutch gear is configured to be driven by the prime mover, wherein the prime mover drives a pinion gear and the clutch gear is a bevelled gear, and wherein the axis of rotation of the pinion gear and bevelled gear are perpendicular to one another.

11. The smart lock of any of claim 9, wherein the clutch is selectively engagable with a stop member of the clutch body to transmit torque from the clutch to the clutch body.

12. The smart lock of claim 11, wherein the clutch comprises a clutch ring and a clutch tab, wherein the clutch tab is selectively engagable with a stop member of the clutch body to transmit torque from the clutch to the clutch body, and wherein the clutch gear comprises a stop member that is selectively engageable with the clutch to transmit torque from the clutch gear to the clutch.

13. The smart lock of claim 9, wherein the prime mover and the clutch assembly are mounted to a motor carriage.

14. The smart lock of claim 1, wherein the drive train may be driven in a first mode by the prime mover and in a second mode by manual rotation of the thumb turn wheel without operation of the prime mover.

15. The smart lock of claim 14, wherein the drive train may be driven in a third mode by operation of the lock mechanism contained within the closure.

16. The smart lock of claim 9, wherein the drive train comprises a geared transmission assembly between the thumb turn wheel and the clutch assembly.

17. The smart lock of claim 16, wherein the geared transmission assembly comprises at least a first output shaft and a second output shaft for supplying torque to the clutch assembly.

18. The smart lock of claim 17, wherein the geared transmission assembly comprises a gear train coupling the first output shaft and the second output shaft.

19. The smart lock of claim 17, wherein either the first output shaft or the second output shaft is coupled to the clutch assembly dependent on whether the prime mover and the clutch assembly are mounted to a motor carriage in a first configuration or a second configuration.

20. The smart lock of claim 9, wherein the drive train comprises an insert for transmitting torque between the clutch assembly and the lock mechanism, wherein the insert is configured to be coupled between the clutch assembly and a lock tailpiece of the lock mechanism, and wherein the lock tailpiece may be configured to replace a whole or a part of the lock mechanism of the closure.

21. The smart lock of claim 20, wherein the lock tailpiece is pre-existing in the lock and shoot bolt of the door closure, or is selected from a plurality of types of lock tailpiece, each type of lock tailpiece being configured to be used with a different design of lock mechanism.

22. The smart lock of claim 1, wherein the button is configured to secure the lock mechanism after a user has left a vicinity of the closure.

23. The smart lock of claim 1, wherein the button is configured to actuate the lock mechanism contained within the closure to secure the lock mechanism after a predetermined delay period.

* * * * *